US006566792B2

(12) United States Patent
Nishikawa

(10) Patent No.: US 6,566,792 B2
(45) Date of Patent: May 20, 2003

(54) SPARK PLUG

(75) Inventor: Kenichi Nishikawa, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/894,876

(22) Filed: Jun. 29, 2001

(65) Prior Publication Data

US 2002/0041138 A1 Apr. 11, 2002

(30) Foreign Application Priority Data

Jun. 30, 2000 (JP) ..... 2000-197770

(51) Int. Cl.[7] ..... F02M 57/06; F02P 13/00; H01T 13/00

(52) U.S. Cl. ..... 313/118; 313/130; 313/143; 501/14; 501/151; 501/153

(58) Field of Search ..... 313/118, 130, 313/137, 143; 501/14, 22, 151, 153, 154

(56) References Cited

U.S. PATENT DOCUMENTS

| | | | | |
|---|---|---|---|---|
| 4,084,976 A | | 4/1978 | Hinton | 501/26 |
| 4,120,733 A | | 10/1978 | Knapp | 501/26 |
| 4,256,497 A | | 3/1981 | Knapp | 501/21 |
| 5,132,587 A | * | 7/1992 | Lemelson | 313/141 |
| 5,677,250 A | | 10/1997 | Knapp | 501/14 |
| 5,859,491 A | | 1/1999 | Nishikawa et al. | 313/141 |
| 6,407,487 B1 | * | 6/2002 | Sugimoto | 313/137 |

FOREIGN PATENT DOCUMENTS

| | | |
|---|---|---|
| EP | 0 959 542 A1 | 11/1999 |
| JP | 10-236845 | 9/1998 |
| JP | 11-43351 | 2/1999 |
| JP | 11-106234 | 4/1999 |

* cited by examiner

*Primary Examiner*—Vip Patel
*Assistant Examiner*—Kevin Quarterman
(74) *Attorney, Agent, or Firm*—Morgan, Lewis & Bockius LLP

(57) ABSTRACT

The glaze layer 2*d* of the spark plug 100 includes oxides of: 15 to 60 mol % of a Si component in terms of $SiO_2$; 22 to 50 mol % of a B component in terms of $B_2O_3$; 10 to 30 mol % of a Zn component in terms of ZnO; 0.5 to 35 mol % of Ba and/or Sr components in terms of BaO or SrO; 1 mol % or less of an F component; 0.1 to 5 mol % of an Al component in terms of $Al_2O_3$; and 5 to 10 mol % in total of at least one of alkaline metal components of Na, K and Li, in terms of $Na_2O$, $K_2O$, and $Li_2$, respectively, wherein Li is essential, and the amount of the Li component is 1.1 to 6 mol % in terms of $Li_2O$.

14 Claims, 8 Drawing Sheets

SPARK PLUG

BACKGROUND OF THE INVENTION

1. Field of the Invention

This invention relates to a spark plug.

2. Description of the Related Art

A spark plug used for ignition of an internal engine of such as automobiles generally comprises a metal shell to which a ground electrode is fixed, an insulator made of alumina ceramics, and a center electrode which is disposed inside the insulator. The insulator projects from the rear opening of the metal shell in the axial direction. A terminal metal fixture is inserted into the projecting part of the insulator and is connected to the center electrode via a conductive glass seal layer which is formed by a glass sealing procedure or a resistor. A high voltage is applied to the terminal metal fixture to cause a spark over the gap between the ground electrode and the center electrode.

Under some combined conditions, for example, at an increased spark plug temperature and an increased environmental humidity, it may happen that high voltage application fails to cause a spark over the gap but, instead, a discharge called as a flashover occurs between the terminal metal fixture and the metal shell, going around the projecting insulator. Primarily for the purpose of avoiding flashover, most of commonly used spark plugs have a glaze layer on the surface of the insulator. The glaze layer also serves to smoothen the insulator surface thereby preventing contamination and to enhance the chemical or mechanical strength of the insulator.

In the case of the alumina insulator for the spark plug, such a glaze of lead silicate glass has conventionally been used where silicate glass is mixed with a relatively large amount of PbO to lower a softening point. In recent years, however, with a globally increasing concern about environmental conservation, glazes containing Pb have been losing acceptance. In the automobile industry, for instance, where spark plugs find a huge demand, it has been a subject of study to phase out Pb glazes in a future, taking into consideration the adverse influences of waste spark plugs on the environment.

Leadless borosilicate glass- or alkaline borosilicate glass-based glazes have been studied as substitutes for the conventional Pb glazes, but they inevitably have inconveniences such as a high glass transition or an insufficient insulation resistance. To address this problem, JP-A-11-43351 proposes a leadless glaze composition having an adjusted Zn component to improve glass stability without increasing viscosity, and JP-A-11-106234 discloses a composition of leadless glaze for improving the insulation resistance by effects of joint addition of alkaline component.

The glaze layer for the spark plug not only prevents the insulator surface from adhering of dirt or stain, heightens withstand voltage of creeping discharge to prevent flashover, but also serves to bury defects in the insulator surface which are apt to cause a destruction starting point for increasing strength. However, in recent internal combustion engines remarkable in high output, vibration and impact received by the spark plug during working, so that problems often occur as breakage of the insulator though being formed with the glaze layer. In addition, when attaching the spark plug to a cylinder head (in particular when attaching with power tools such as impact wrench), if adding over tightening torque, the insulator will be broken. Further, since voltage applied to the spark plug is getting higher accompanied with high performance of engines, the glaze has been demanded to have an insulating performance durable against severe circumstances, but compositions of the glaze disclosed in JP-A-11-106234 or JP-A-11-43351 are involved with problems that the glaze compositions compatible in the insulation performance and mechanical properties are not always investigated.

SUMMARY OF THE INVENTION

It is accordingly an object of the invention to provide spark plugs having such glaze layers containing less Pb component, enabling to be baked at relatively low temperatures, having excellent insulating property, easily realizing smooth baked surfaces, and heightening the mechanical strength of the insulator with the glaze layer.

For solving the above problems, the spark plug of the invention has an insulator comprising alumina based ceramic disposed between a center electrode and a metal shell, wherein at least part of the surface of the insulator is covered with a glaze layer comprising oxides, and is characterized in that the glaze layer comprises Pb component 1 mol % or less in terms of PbO;

Si component 15 to 60 mol % in terms of $SiO_2$;

B component 22 to 50 mol % in terms of $B_2O_3$;

Zn component 10 to 30 mol % in terms of ZnO;

Ba and/or Sr components 0.5 to 35 mol % in terms of BaO or SrO;

F component 1 mol % or less,

Al component 0.1 to 5 mol % in terms of $Al_2O_3$; and alkaline metal components of 5 to 10 mol % in total of one kind or more of Na, K and Li in terms of $Na_2O$, $K_2O$, and $Li_2$, respectively, where Li is essential, and the amount of the Li component is 1.1 to 6 mol % in terms of $Li_2O$.

In the spark plug according to the invention, for aiming at the adaptability to the environmental problems, it is a premise that the glaze to be used contains the Pb component 1.0 mol % or less in terms of PbO (hereafter called the glaze containing the Pb component reduced to this level as "leadless glaze") When the Pb component is present in the glaze in the form of an ion of lower valency (e.g., $Pb^{2+}$), it is oxidized to an ion of higher valency (e.g., $Pb^{3+}$) by a corona discharge. If this happens, the insulating properties of the glaze layer are reduced, which probably spoils an anti-flashover. From this viewpoint, too, the limited Pb content is beneficial. A preferred Pb content is 0.1 mol % or less. It is most preferred for the glaze to contain substantially no Pb (except a trace amount of lead unavoidably incorporated from raw materials of the glaze).

However, according to an inventor's studies, it was proved that if the amount of Pb component was smaller, a mechanical strength of the glaze layer, in particular impact resistance was apt to relatively decrease. Therefore, it was found that if Si, B, Zn, Ea and/or Sr, and Al components, further alkaline metal component were contained in the above mentioned range, such glaze layers could be provided, enabling to be baked at relatively low temperatures, having excellent insulating property, easily realizing smooth baked surfaces, and heightening the mechanical strength, especially the impact resistance of the insulator formed with the glaze layer, and thus the present invention has been accomplished. Thereby, in case the spark plug is attached to the high output internal combustion engine, the insulator of the spark plug is unlikely to break by such as vibrations during working. Further, if tightening torque somewhat exceeds when attaching the spark plug to the cylinder head (especially when attaching with power tools such as an impact wrench), the insulator is unlikely to break.

In the following, reference will be made to critical meanings of ranges containing respective composing components of the glaze layer in the present spark plug. Si component is a skeleton forming component of the glaze layer of vitreous substance, and is indispensable for securing the insulating property. With respect to the Si component, being less than 15 mol %, it is often difficult to secure a sufficient insulating performance. Being more than 60 mol %, it is often difficult to bake the glaze. The Si containing amount should be more preferably 25 to 40 mol %.

B component is also a skeleton forming component of the glaze layer of vitreous substance, and if combined with Si a skeleton forming component of the glaze layer of vitreous substance, a softening point of the glaze is lowered and fluidity when baking the glaze is improved for easily obtaining smooth baked surfaces. If the B containing amount is less than 20 mol %, the softening point of the glaze goes up, and the baking of the glaze will be difficult. On the other hand, being more than 55 mol %, inferior external appearance such as a glaze crimping is easily caused. Or, waterproof might be spoiled. Depending on containing amounts of other components, such apprehensions might occur as a devitrification the glaze layer, the lowering of the insulating property, or inconsequence of the thermal expansion coefficient in relation with the substrate. It is good to determine the B containing amount to range 25 to 35 mol % if possible.

Zn component heightens the fluidity when baking the glaze in substitution for Pb component for easily obtaining the smooth baked surfaces. If compounding Zn component more than a predetermined amount, difference in coefficient of thermal expansion between a substrate of the insulator of alumina based ceramic and the glaze layer is reduced to prevent occurrence of defects in the glaze layer and to restrain residual level of tension residual stress, and heighten strength of the insulator formed with the glaze layer, in particular the impact resistance. If the Zn containing amount is less than 10 molt, the thermal expansion coefficient of the glaze layer is too large, defects such as crazing are easily occur in the glaze layer. As the Zn component acts to lower the softening point of the glaze, if it is short, the baking of the glaze will be difficult. Being more than 30 mol %, opacity easily occurs in the glaze layer due to the devitrification. It is good that the Zn containing amount to determine 10 to 20 mol %.

Ba and Sr components contribute to heightening of the insulating property of the glaze layer and is effective to increasing of the strength. If the total amount is less than 0.5 mol %, the insulating property of the glaze layer goes down, and the anti-flashover might be spoiled. Being more than31 mol %, the thermal expansion coefficient of the glaze layer is too high, defects such as crazing are easily occur in the glaze layer. Tension stress is easy to remain in the glaze layer when cooling from high temperatures, and strength of the insulator formed with the glaze layer, e.g., the impact resistance is easily spoiled. In addition, the opacity easily occurs in the glaze layer. From the viewpoint of heightening the insulating property and adjusting the thermal expansion coefficient, the total amount of Ba and Sr is desirably determined to be 0.5 to 20 mol %, and in particular if the Si component ranges 25 to 40 mol %, the effect is large. Either or both of the Ba and Sr component may be contained, but the Ba component is advantageously cheaper in a cost of a raw material.

The Ba and Sr components may exist in forms other than oxides in the glaze depending on raw materials to be used. For example, $BaSO_4$ is used as a source of the Ba component, an S component might be residual in the glaze layer. This sulfur component is concentrated nearly to the surface of the glaze layer when baking the glaze to lower the surface expansion of a melted glaze and to heighten a smoothness of a glaze layer to be obtained.

A reason for F component to be 1 mol % or lower is why if the glaze contains F component of more than 1 mol % (if adding into the glaze, e.g., a catalyst containing F component such as $CaF_2$ (fluorite), p component is inevitably mixed), air bubbles are ready for a rising which are easy to cause breakdown in the glaze when baking it, this attributes to spoiling of the strength of the insulator having the glaze layer, for example, the impact resistance. Further, a gas bearing F component issues when baking the glaze, and this trends to invite inconveniences of reacting with a refractory composing an oven wall to shorten the life of the oven wall. More desirably, F component is not contained in the glaze layer if possible, and it is better not to use the catalyst containing F component as $CaF_2$ if circumstances allow.

Al component broadens a temperature range available for baking the glaze, stabilizes the fluidity when baking the glaze, and largely heightens the impact resistance of the insulator formed with the glaze. But if being less than 0.1 mol % in terms of oxide, the effect thereof lacks. Further, if being over 5 mol %, the glaze layer to be produced is opaque and mat, and the external appearance of the spark plug is spoiled, and markings formed on the substrate are illegible, resulting in inconveniences as when de-vitrifying. The amount of Al component is desirably 1 to 3 mol %.

Next, the alkaline metal components in the glaze layer is mainly used to lower the softening point of the glaze layer and to heighten the fluidity when baking the glaze. The total amount thereof is determined to be 1.1 to 10 mol %. In case of being less than 1.1 mol %, the softening point of the glaze goes up, baking of the glaze might be probably impossible. In case of being more than 10 mol %, the insulating property probably goes down, and an anti-flashover might be spoiled. The containing amount of the alkaline metal components is preferably 5 to 8 mol %. With respect to the alkaline metal components, not depending on one kind, but adding in joint two kinds or more selected from Na, K and Li, the insulating property of the glaze layer is more effectively restrained from lowering. As a result, the amount of the alkaline metal components can be increased without decreasing the insulating property, consequently it is possible to concurrently attain the two purposes of securing the fluidity when baking the glaze and the anti-flashover (so-called alkaline joint addition effect).

Among the above mentioned alkaline metal components, Li component has particularly high effect for improving the fluidity when baking the glaze, and is not only useful for obtaining the baked smooth surface with lesser defects but also remarkably effective for suppressing increase of the thermal expansion coefficient, and considerably controls tension residual stress appearing in the glaze layer. Each of these effects displays to improve strength of the insulator with the glaze layer, for example, the impact resistance. If being less than 1.1 mol % in terms of oxide of Li component, the effect is poor, and being more than 6 mol %, the insulating property of the glaze layer is not sufficiently secured. The amount of Li component is desirably 2 to 4 mol %.

Further reference will be made to desirable compositions of the glaze layer.

It is desirable that the glaze layer contains Zn component of NZnO (mol %) in terms of ZnO, Ba component of NBaO (mol %) in terms of BaO, and Sr component of NSrO (mol %) in terms of SrO, and the total amount of NZnO+NBaO+NSrO is 15 to 45 mol %. If exceeding 45 mol %, the glaze layer will be devitrified and slightly opaque. For example, on the outer surface of the insulator, visual information such as letters, figures or product numbers are printed and baked with color glazes for identifying makers and others, and owing to the slight opaqueness, the printed visual information is sometimes illegible.

Or, if being less than 15 mol %, the softening point exceedingly goes up to make the glaze baking difficult and cause bad external appearance. Thus, the total amount is more desirably 15 to 25 mol %.

The glaze layer is preferably to be NZnO>NBaO+NSrO. Thereby, it is possible to make the thermal expansion coefficient of the glaze layer smaller, more shorten the difference in the thermal expansion coefficient from alumina based ceramic to be the substrate to reduce the tension stress level remaining in the glaze layer after baking, and moreover to bring the residual stress under a condition of compressive stress. As a result, the impact resistance of the glaze layer can be more heightened.

It is desirable that Li component is determined to be in a range of $0.2 \leqq Li/(Na+K+Li) \leqq 0.5$ in mol % in terms of oxides as above mentioned. If being less than 0.2, the thermal expansion coefficient is too large in comparison with alumina of the substrate, and consequently, defects such as crazing are easy to occur and finishing of the baked glaze surface is insufficiently secured. On the other hand, if being more than 0.5, since Li ion is relatively high in migration among alkaline metal ions, bad influences might be affected to insulating property of the glaze layer. Values of Li/(Na+K+Li) are more desirably adjusted to be 0.3 to 0.45. For more heightening the effect of improving the insulating property, it is possible to compound other alkaline metal components than third components such as K, Na and subsequent components in ranges of not spoiling the effect of controlling conductivity by excessive co-addition of alkaline metal component. Especially desirably, the three components are all contained.

Further, it is preferable that the glaze layer satisfies that NB2O3/(NZnO+NBaO+NSrO) is 0.5 to 2.0. Being less than 0.5, the glaze layer is easily de-vitrified, and being over 2.0, the softening point of the glaze layer goes up to make sometimes the glaze baking difficult.

It is possible to contain one kind or more of Ti, Zr and Hf 0.5 to 5 mol % in total in terms of $ZrO_2$, $TiO_2$ and $HfO_2$.

By containing one kind or more of Ti, Zr or Hf, a water resistance is improved. As to the Zr or Hf components, the improved effect of the water resistance of the glaze layer is more noticeable. By the way, "the water resistance is good" is meant that if, for example, a powder like raw material of the glaze is mixed together with a solvent as water and is left as a glaze slurry for a long time, such inconvenience is difficult to occur as increasing a viscosity of the glaze slurry owing to elusion of the component. As a result, in case of coating the glaze slurry to the insulator, optimization of a coating thickness is easy and unevenness in thickness is reduced. Subsequently, said optimization and said reduction can be effectively attained. If being less than 0.5 mol %, the effect is poor, and if being more than 5 mol %, the glaze layer is ready for devitrification.

It is possible to contain Mo, W, Ni, Co, Fe and Mn (called as "fluidity improving transition metal component" hereafter) 0.5 to 5 mol % in total in terms of $MoO_3$, $WO_3$, $Ni_3O_4$, $Co_3O_4$, $Fe_2O_3$, and $MnO_2$, respectively. If adding one kind or more of Mo, W, Ni, Co, Fe and Mn in the above mentioned containing range, it is possible to secure the fluidity when baking the glaze. Therefore, the glaze layer having the excellent insulating property can be obtained by baking at relatively low temperatures. Due to the baked smooth surface, the impact resistance of the insulator with the glaze layer thereon can be heightened further.

If the total amount in terms of oxides is less than 0.5 mol %, it may be difficult to obtain a sufficient effect of improving the fluidity when baking the glaze and of easily obtaining a smooth glaze layer. On the other hand, if exceeding 5 mol %, it may be difficult or impossible to bake the glaze owing to an excessive rise of the softening point of the glaze.

When the containing amount of the fluidity improving transition metal component is excessive, coloring may unintentionally appear in the glaze layer. For example, visual information such as letters, figures or product numbers are printed with color glazes on external appearances of the insulators for specifying manufacturers and others. However, if the colors of the glaze layer is too thick, it might be difficult to read out the printed visual information through the glaze layer. As another realistic problem, there is a case that tint changing resulted from alternation in the glaze composition is seen to purchasers as "unreasonable alternation in familiar colors in external appearance", so that an inconvenience occurs that products could not always be willingly accepted because of a resistant feeling thereto.

The insulator forming a substrate of the glaze layer comprises alumina based ceramics taking white, and in view of preventing or restraining coloration, it is desirable that the coloration in an observed external appearance of the glaze layer formed in the insulator is adjusted to be 0 to 6 in chroma Cs and 7.5 to 10 in lightness Vs, for example, the amount of the above transition metal component is adjusted. If the chroma of the glaze layer exceeds 6, the coloration of the glaze layer is remarkably perceived. On the other hand, if the lightness is less than 7.5, the gray or blackish coloration is easily perceived. In either way, there appears a problem that an impression of "apparent coloration" cannot be prevented. The chroma Cs is preferably 8 to 10, more preferably 9 to 10. In the present specification, a measuring method of the lightness Vs and the chroma Cs adopts the method specified in "4.3 A Measuring Method of Reflected Objects" of "4. Spectral Colorimetry" in the "A Measuring Method of Colors" of JIS-Z8722 (1994). And the result measured by the above method is compared with standard color chart prepared according to JIS-Z8721 to know the lightness and the chroma.

As a simple substitutive method, the lightness and the chroma can be known just through visual comparisons with standard color chart prepared according to JIS-Z8721 (1993).

The effect of improving the fluidity when baking the glaze is remarkably exhibited by W next to Mo and Fe. For example, it is possible that all the essential transition metal components are made Mo, Fe or W. For more heightening the effect of improving the fluidity when baking the glaze, it is preferable that Mo is 50 mol % or more of the fluidity improving transition metal components.

The glaze layer may contain one or two kinds of Ca component of 1 to 10 mol % in terms of CaO and Mg component of 0.1 to 10 mol % in terms of MgO in the total amount of 1 to 12 mol %. These components contribute to improvement of the insulating property of the glaze layer. Especially, Ca component is effective next to Ba component and Zn component, aiming at improvement of the insulating property. If the addition amount is less than their lower limits, the effective may be poor, or exceeding their upper limits or the upper limit of the total amount, the baking glaze may be difficult or impossible owing to excessive increase of the softening point.

Auxiliary components of one kind or more of Bi, Sn, Sb, P, Cu, Ce and Cr may be contained 5 mol % or less in total as Bi in terms of $Bi_2O_3$, Sn in terms of $SnO_2$, Sn in terms of $Sb_2O_5$, P in terms of $P_2O_5$, Cu in terms of CuO, Ce in terms of $CeO_2$, and Cr in terms of $Cr_2O_3$. These components may be positively added in response to purposes or often inevitably included as raw materials of the glaze (otherwise later mentioned clay minerals to be mixed when preparing a glaze slurry) or impurities (otherwise contaminants) from refractory materials in the melting procedure for producing glaze frit. Each of them heightens the fluidity when baking the glaze, restrains bubble formation in the glaze layer, or wraps adhered materials on the baked glaze surface so as to prevent abnormal projections. Bi and Sb are especially effective.

In the composition of the spark plug of the invention, the respective components in the glaze are contained in the forms of oxides in many cases, and owing to factors forming amorphous and vitreous phases, existing forms as oxides cannot be often identified. In such cases, if the containing amounts of components at values in terms of oxides fall in the above mentioned ranges, it is regarded that they belong to the ranges of the invention.

The containing amounts of the respective components in the glaze layer formed on the insulator can be identified by use of known micro-analyzing methods such as EPMA (electronic probe micro-analysis) or XPS (X-ray photoelectron spectroscopy) For example, if using EPMA, either of a wavelength dispersion system and an energy dispersion system is sufficient for measuring characteristic X-ray. Further, there is a method where the glaze layer is peeled from the insulator and is subjected to a chemical analysis or a gas analysis for identifying the composition.

If the above mentioned composition is employed for the glaze layer, taking, as a backward direction, a side remote from spark discharge gap in an axial direction of the insulator, the metal shell is fixed such that the backward part of the insulator projecting from the metal shell is perpendicular with respect to a test article securing bed, while an arm of 330 mm length furnished at the front end with a steel made hammer of 1.13 kg is turnably attached to an axial fulcrum located on a center axial line of the insulator at a more upper part of the backward part of the insulator, and a location of the axial fulcrum is determined such that a position of the hammer when it is brought down onto the backward part of the insulator is 1 mm as a distance in the vertical direction from the backward face of the insulator, the hammer is brought up such that a turning angle of the arm is at predetermined angle from the center axial line, and when operation of bringing down the hammer owing to free dropping toward the backward part of the insulator is repeated as stepwise making larger at distance of 2 degree, impact endurance angle demanded as a limit angle when cracks appear in the insulator is 35 degree or more. Thereby, even if vibration/impact are received, or when the spark plug is attached to the high output internal combustion engine or to the cylinder head (especially when attaching with power tools such as an impact wrench), even if tightening torque somewhat exceeds, the insulator is effectively restrained from breakdown.

The insulator is formed with a projection part in an outer circumferential direction at an axially central position thereof. Taking, as a front side, a side directing toward the front end of the center electrode in the axial direction, a cylindrical face is shaped in the outer circumferential face at the base portion of the insulator main body in the neighborhood of a rear side opposite the projection part. In this case, the outer circumferential face at the base portion is covered with the glaze layer formed with the film thickness ranging 7 to 50 $\mu$m.

In automobile engines, such a practice is broadly adopted that the spark plug is attached to engine electric equipment system by means of rubber caps, and for heightening the anti- flashover, important is the adherence between the insulator and the inside of the rubber cap. The inventors made earnest studies and found that, in the leadless glaze of borosilicate glass or alkaline borosilicate, it is important to adjust thickness of the glaze layer for obtaining a smooth surface of the baked glaze, and as the outer circumference of the base portion of the insulator main body particularly requires the adherence with the rubber cap, unless appropriate adjustment is made to the film thickness, a sufficient anti-flashover cannot be secured. Therefore, in the insulator having the leadless glaze layer of the above mentioned composition of the spark plug according to the third invention, if the film thickness of the glaze layer covering the outer circumference of the base portion of the insulator is set in the range of the above numerical values, the adherence between the baked glaze face and the rubber cap may be heightened, and in turn the anti-flashover may be improved without lowering the insulating property of the glaze layer.

By adjusting the thickness of the glaze layer as mentioned above, the impact resistance of the insulator formed with the glaze layer can be more improved. If the thickness of the glaze layer at said portion of the insulator is less than 7 $\mu$m, the anti-flashover property is insufficient, otherwise the glaze layer is too thin, so that an absolute strength or a defect covering effect in the insulator surface is not enough, and the impact resistance is short. On the other hand, if the thickness of the glaze layer exceeds 50 $\mu$m, it is difficult to secure the insulator with the leadless glaze layer of the above mentioned composition, similarly resulting in decrease of the anti-flashover or resulting in too much increase after baking the glaze of the residual stress amount to be determined with balance between the thermal expansion rate and the thickness of the glaze layer so that the impact resistance might lack. The thickness of the glaze layer is desirably 10 to 30 $\mu$m.

The spark plug having the glaze layer of the invention may be composed by furnishing, in a crazing hole of the insulator, an axially shaped terminal metal fixture as one body with the center electrode or holding a conductive binding layer in relation therewith, said metal fixture being separate from a center electrode. In this case, the whole of the spark plug is kept at around 500° C., and an electric conductivity is made between the terminal metal fixture and a metal shell, enabling to measure the insulating resistant value. For securing an insulating endurance at high temperatures, it is desirable that the insulating resistant value is secured 200 MΩ or higher so as to prevent the flashover.

FIG. 4 shows one example of measuring system. That is, DC constant voltage source (e.g., source voltage 1000 V) is connected to a terminal metal 13 of the spark plug 100, while at the same time, the metal shell 1 is grounded, and a current is passed under a condition where the spark plug 100 disposed in a heating oven is heated at 500° C. For example, imagining that a current value Im is measured by use of a current measuring resistance (resistance value Rm) at the voltage VS, an insulation resistance value Rx to be measured can be obtained as (VS/Im)−Rm (in the drawing, the current value Im is measured by output of a differential amplifier for amplifying voltage difference at both ends of the current measuring resistance).

The insulator may include the alumina insulating material containing the Al component 85 to 98 mol % in terms of $Al_2O_3$. Preferably, the glaze layer has an average thermal expansion coefficient of $50\times10^{-7}$/° C. to $85\times10^{-7}$/° C. at the temperature ranging 20 to 350° C. Being less than this lower limit, defects such as cracking or graze skipping easily happen in the graze layer. On the other hand, being more than the upper limit, defects such as crazing are easy to happen in the graze layer. The thermal expansion coefficient more preferably ranges $60\times10^{-7}$/° C. to $80\times10^{-7}$/° C.

The thermal expansion coefficient of the glaze layer is assumed in such ways that samples are cut out from a vitreous glaze bulk body prepared by mixing and melting raw materials such that almost the same composition as the glaze layer is realized, and values measured by a known dilatometer method.

The thermal expansion coefficient of the glaze layer on the insulator can be measured by use of, e.g., a laser interferometer or an interatomic force microscope.

The spark plug of the invention can be produced by a production method comprising

- a step of preparing glaze powders in which the raw material powders are mixed at a predetermined ratio, the mixture is heated 1000 to 1500° C. and melted, the melted material is rapidly cooled, vitrified and ground into powder;
- a step of piling the glaze powder on the surface of an insulator to form a glaze powder layer; and
- a step of heating the insulator, thereby to bake the glaze powder layer on the surface of the insulator.

The powdered raw material of each component includes not only an oxide thereof (sufficient with complex oxide) but also other inorganic materials such as hydroxide, carbonate, chloride, sulfate, nitrate, or phosphate. These inorganic materials should be those of capable of being converted to corresponding oxides by heating and melting. The rapidly cooling can be carried out by throwing the melt into a water or atomizing the melt onto the surface of a cooling roll for obtaining flakes.

The glaze powder is dispersed into the water or solvent, so that it can be used as a glaze slurry. For example, if coating the glaze slurry onto the insulator surface to dry it, the piled layer of the glaze powder can be formed as a coated layer of the glaze slurry. By the way, as the method of coating the glaze slurry on the insulator surface, if adopting a method of spraying from an atomizing nozzle onto the insulator surface, the piled layer in uniform thickness of the glaze powder can be easily formed and an adjustment of the coated thickness is easy.

The glaze slurry can contain an adequate amount of a clay mineral or an organic binder for heightening a shape retention of the piled layer of the glaze powder. As the clay mineral, those comprising mainly aluminosolicate hydrates can be applied, for example, those comprising mainly one kind or more of allophane, imogolite, hisingerite, smectite, kaolinite, halloysite, montmorillonite, vermiculite, and dolomite (or mixtures thereof) can be used. In relation with the oxide components, in addition to $SiO_2$ and $Al_2O_3$, those mainly containing one kind or more of $Fe_2O_3$, $TiO_2$, CaO, MgO, $Na_2O$ and $K_2O$ can be used.

The spark plug of the invention is constructed of an insulator having a through-hole formed in the axial direction thereof, a terminal metal fixture fitted in one end of the through-hole, and a center electrode fitted in the other end. The terminal metal fixture and the center electrode are electrically connected via an electrically conductive sintered body mainly comprising a mixture of a glass and a conductive material (e.g., a conductive glass seal or a resistor). The spark plug having such a structure can be made by a process including the following steps.

An assembly step: a step of assembling a structure comprising the insulator having the through-hole, the terminal metal fixture fitted in one end of the through-hole, the center electrode fitted in the other end, and a filled layer formed between the terminal metal fixture and the center electrode, which filled layer comprises the glass powder and the conductive material powder.

A glaze baking step: a step of heating the assembled structure formed with the piled layer of the glaze powder on the surface of the insulator at temperature ranging 800 to 950° C. to bake the piled layer of the glaze powder on the surface of the insulator so as to form a glaze layer, and at the same time softening the glass powder in the filled layer.

A pressing step: a step of bringing the center electrode and the terminal metal fixture relatively close within the through-hole, thereby pressing the filled layer between the center electrode and the terminal metal fixture into the electrically conductive sintered body.

In this case, the terminal metal fixture and the center electrode are electrically connected by the electrically conductive sintered body to concurrently seal the gap between the inside of the through-hole and the terminal metal fixture and the center electrode. Therefore, the glaze baking step also serves as a glass sealing step. This process is efficient in that the glass sealing and the glaze baking are performed simultaneously. Since the above mentioned glaze allows the baking temperature to be lower to 800 to 950° C., the center electrode and the terminal metal fixture hardly suffer from bad production owing to oxidation so that the yield of the spark plug is heightened. It is also sufficient that the baking glaze step is preceded to the glass sealing step.

The softening point of the glaze layer is preferably adjusted to range, e.g., 520 to 700° C. When the softening point is higher than 700° C., the baking temperature above 950° C. will be required to carry out both baking and glass sealing, which may accelerate oxidation of the center electrode and the terminal metal fixture. When the softening point is lower than 520° C., the glaze baking temperature should be set lower than 800° C. In this case, the glass used in the conductive sintered body must have a low softening point in order to secure a satisfactory glass seal. As a result, when an accomplished spark plug is used for a long time in a relatively high temperature environment, the glass in the conductive sintered body is liable to denaturalization, and where, for example, the conductive sintered body comprises a resistor, the denaturalization of the glass tends to result in deterioration of the performance such as a life under load. Incidentally, the softening point of the glaze is adjusted at temperature range of 520 to 620° C.

The softening point of the glaze layer is a value measured by performing a differential thermal analysis on the glaze layer peeled off from the insulator and heated, and it is obtained as a temperature of a peak appearing next to a first endothermic peak (that the second endothermic peak) which is indicative of a sag point. The softening point of the glaze layer formed in the surface of the insulator can be also estimated from a value obtained with a glass sample which is prepared by compounding raw materials so as to give substantially the same composition as the glaze layer under analysis, melting the composition and rapidly cooling.

Figure 1:
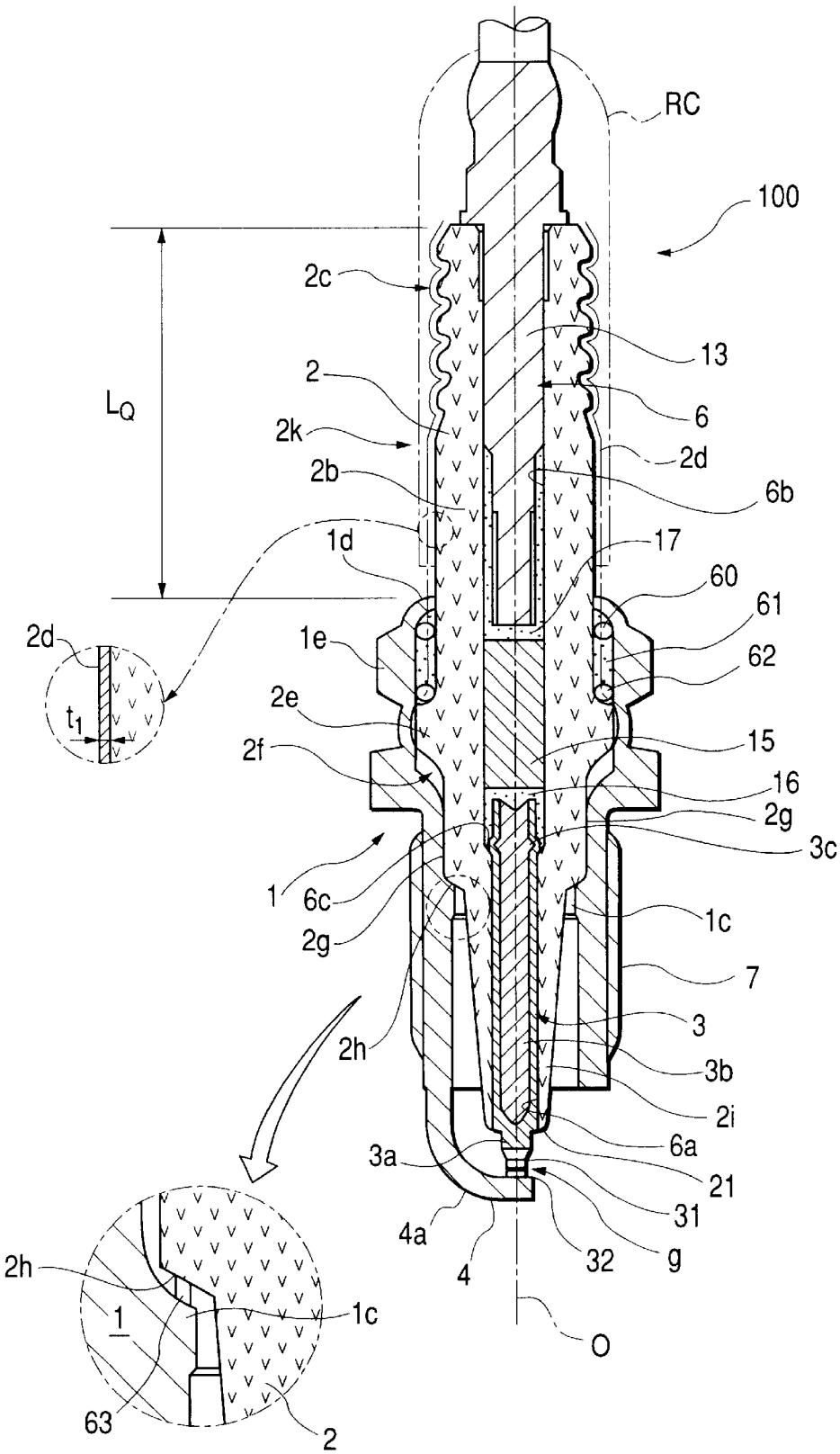
FIG. 1 is a whole front and cross sectional view showing the spark plug according to the invention.

The reference numerals used in the drawings are shown below.

1: Metal shell

2: Insulator

2*d*: Glaze layer

2*d*': Blaze slurry coated layer (Glaze powder piled layer)

3: Center electrode

4: Ground electrode

5: Glaze slurry

DETAILED DESCRIPTION OF THE INVENTION

Modes for carrying out the invention will be explained with reference to the accompanying drawings. FIG. 1 shows an example of the spark plug of the first structure according to the invention. The spark plug 100 has a cylindrical metal shell 1, an insulator 2 fitted in the inside of the metal shell 1 with its tip 21 projecting from the front end of the metal shell 1, a center electrode 3 disposed inside the insulator 2 with its ignition part 31 formed at the tip thereof, and a ground electrode 4 with its one end welded to the metal shell 1 and the other end bent inward such that a side of this end may face the tip of the center electrode 3. The ground electrode 4 has an ignition part 32 which faces the ignition part 31 to make a spark gap g between the facing ignition parts.

The metal shell 1 is formed to be cylindrical of such as a low carbon steel. It has a thread 7 therearound for screwing the spark plug 100 into an engine block (not shown). Symbol 1*e* is a hexagonal nut portion over which a tool such as a spanner or wrench fits to fasten the metal shell 1.

The insulator 2 has a through-hole 6 penetrating in the axial direction. A terminal fixture 13 is fixed in one end of the through-hole 6, and the center electrode 3 is fixed in the other end. A resistor 15 is disposed in the through-hole 6 between the terminal metal fixture 13 and the center electrode 3. The resistor 15 is connected at both ends thereof to the center electrode 3 and the terminal metal fixture 13 via the conductive glass seal layers 16 and 17, respectively. The resistor 15 and the conductive glass seal layers 16, 17 constitute the conductive sintered body. The resistor 15 is formed by heating and pressing a mixed powder of the glass powder and the conductive material powder (and, if desired, ceramic powder other than the glass) in a later mentioned glass sealing step. The resistor 15 may be omitted, and the terminal metal fixture 13 and the center electrode 3 may be integrally constituted by one seal layer of the conductive glass seal.

The insulator 2 has the through-hole 6 in its axial direction for fitting the center electrode 3, and is formed as a whole with an insulating material as follows. That is, the insulating material is mainly comprising an alumina ceramic sintered body having an Al content of 85 to 98 mass % (preferably 90 to 98 mass %) in terms of $Al_2O_3$.

The specific components other than Al are exemplified as follows.

Si component: 1.50 to 5.00 mol % in terms of $SiO_2$;

Ca component: 1.20 to 400 mol % in terms of CaO;

Mg component: 0.05 to 0.17 mol % in terms of MgO;

Ba component: 0.15 to 0.50 mol % in terms of BaO; and

B component; 0.15 to 0.50 mol % in terms of $B_2O_3$.

The insulator 2 has a projection 2*e* projecting outwardly, e.g., flange-like on its periphery at the middle part in the axial direction, a rear portion 2*b* whose outer diameter is smaller than the projecting portion 2*e*, a first front portion 2*g* in front of the projecting portion 2*e*, whose outer diameter is smaller than the projecting portion 2*e*, and a second front portion 2*i* in front of the first front portion 2*g*, whose outer diameter is smaller than the first front portion 2*g*. The rear end part of the rear portion 2*b* has its periphery corrugated to form corrugations 2*c*. The first front portion 2*g* is almost cylindrical, while the second front portion 2*i* is tapered toward the tip 2*l*.

On the other hand, the center electrode 3 has a smaller diameter than that of the resistor 15. The through-hole 6 of the insulator 2 is divided into a first portion 6*a* (front portion) having a circular cross section in which the center electrode 3 is fitted and a second portion 6*b* (rear portion) having a circular cross section with a larger diameter than that of the first portion 6*a*. The terminal metal fixture 13 and the resistor 15 are disposed in the second portion 6*b*, and the center electrode 3 is inserted in the first portion 6*a*. The center electrode 3 has an outward projection 3*c* around its periphery near the rear end thereof, with which it is fixed to the electrode. A first portion 6*a* and a second portion 6*b* of the through-hole 6 are connected each other in the first front portion 2*g* in FIG. 3A, and at the connecting part, a projection receiving face 6*c* is tapered or rounded for receiving the projection 3*c* for fixing the center electrode 3.

The first front portion 2*g* and the second front portion 2*i* of the insulator 2 connect at a connecting part 2*h*, where a level difference is formed on the outer surface of the insulator 2. The metal shell 1 has a projection 1*c* on its inner wall at the position meeting the connecting part 2*h* so that the connecting part 2*h* fits the projection 1*c* via a gasket ring 63 thereby to prevent slipping in the axial direction. A gasket ring 62 is disposed between the inner wall of the metal shell 1 and the outer side of the insulator 2 at the rear of the flange-like projecting portion 2*e*, and a gasket ring 60 is provided in the rear of the gasket ring 62. The space between the two gaskets 60 and 62 is filled with a filler 61 such as talc. The insulator 2 is inserted into the metal shell 1 toward the front end thereof, and under this condition, the rear opening edge of the metal shell lis pressed inward the gasket 60 to form a sealing lip 1*d*, and the metal shell 1 is secured to the insulator 2.

Figure 3A:
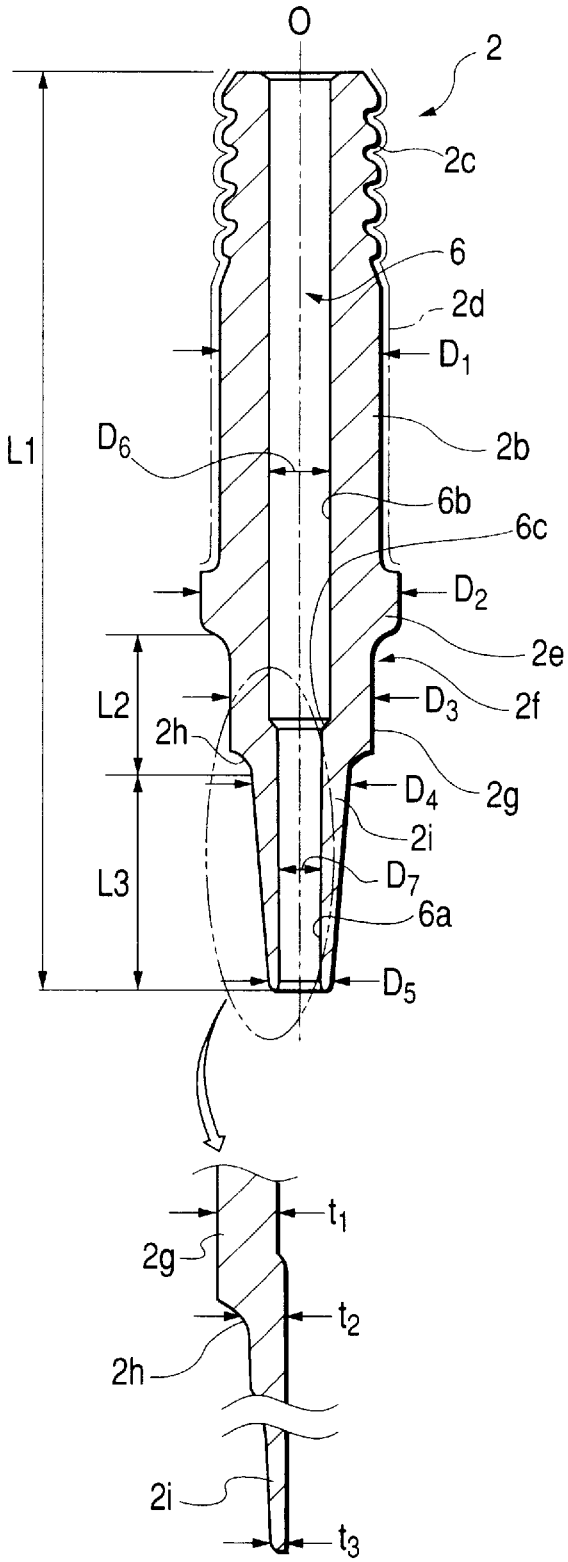
FIGS. 3A and 3B are vertical cross sectional views showing some examples of the insulator.
Figure 3B:
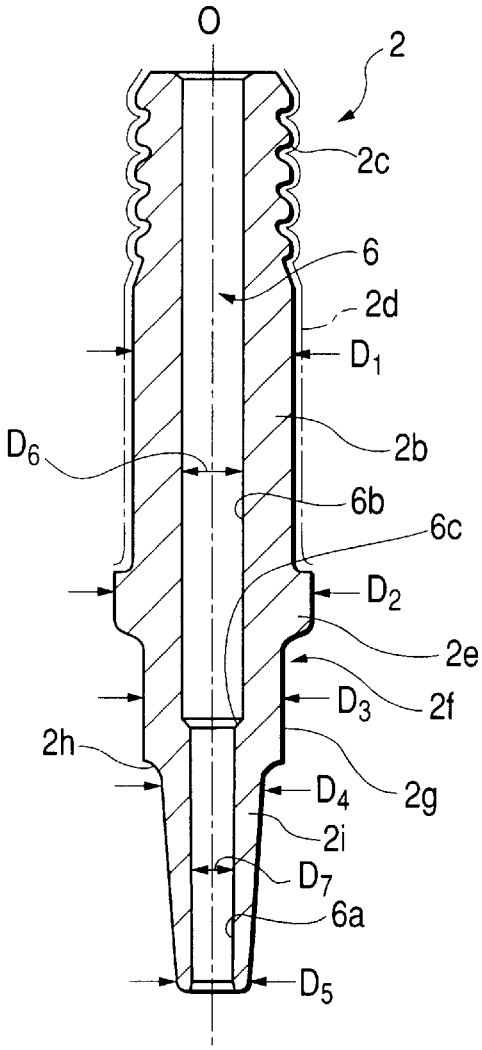

FIGS. 3A and 3B show practical examples of the insulator 2. The ranges of dimensions of these insulators are as follows.

Total length L1: 30 to 75 mm;

Length L2 of the first front portion 2 g: 0 to 30 mm (exclusive of the connecting part 2*f* to the projecting portion 2*e* and inclusive of the connecting part 2*h* to the second front portion 2*i*);

Length L3 of the second front portion 2*i*: 2 to 27 mm;
Outer diameter D1 of the rear portion 2*b:* 9 to 13 mm;
Outer diameter D2 of the projecting portion 2*e:* 11 to 16 mm;
Outer diameter D3 of the first front portion 2*g:* 5 to 11 mm;
Outer base diameter D4 of the second front portion 2*i:* 3 to 8 mm;

Outer tip diameter D5 of the second front portion 2*i* (where the outer circumference at the tip is rounded or beveled, the outer diameter is measured at the base of the rounded or beveled part in a cross section containing the center axial line O): 2.5 to 7 mm;
Inner diameter D6 of the second portion 6*b* of the through-hole 6: 2 to 5 mm;
Inner diameter D7 of the first portion 6*a* of the through-hole 6: 1 to 3.5 mm;
Thickness t1 of the first front portion 2*g:* 0.5 to 4.5 mm;
Thickness t2 at the base of the second front portion 2*i* (the thickness in the direction perpendicular to the center axial line O): 0.3 to 3.5 mm;
Thickness t3 at the tip of the second front portion 2*i* (the thickness in the direction perpendicular to the center axial line O; where the outer circumference at the tip is rounded or beveled, the thickness is measured at the base of the rounded or beveled part in a cross section containing the center axial line O): 0.2 to 3 mm; and
Average thickness tA (=(t2+t3)/2) of the second front portion 2*i:* 0.25 to 3.25 mm.

In FIG. 1, a length LQ of the portion 2*k* of the insulator 2 which projects over the rear end of the metal shell 1, is 23 to 27 mm (e.g., about 25 mm). In a vertical cross section containing the center axial line O of the insulator 2 on the outer contour of the projecting portion 2*k* of the insulator 2, the length LP of the portion 2*k* as measured along the profile of the insulator 2 is 26 to 32 mm (e.g., about 29 mm) starting from a position corresponding to the rear end of the metal shell 1, through the surface of the corrugations 2*c*, to the rear end of the insulator 2.

The insulator 2 shown in FIG. 3A has the following dimensions. L1=ca. 60 mm, L2=ca. 10 mm, L3=ca. 14 mm, D1=ca. 11 mm, D2=ca. 13 mm, D3=ca. 7.3 mm, D4 =5.3 mm, D5=4.3 mm, D6=3.9 mm, D7=2.6 mm, t1=3.3 mm, t2=1.4 mm, t3=0.9 mm, and tA=1.15 mm.

The insulator 2 shown in FIG. 3B is designed to have slightly larger outer diameters in its first and second front portions 2*g* and 2*i* than in the example shown in FIG. 3A. It has the following dimensions. L1=ca. 60 mm, L2=ca. 10 mm, L3=ca. 14 mm, D1=ca. 11 mm, D2=ca. 13 mm, D3=ca. 9.2 mm, D4=6.9 mm, D5=5.1 mm, D6=3.9 mm, D7=2.7 mm, t1=3.3 mm, t2=2.1 mm, t3 =1.2 mm, and tA=1.65 mm.

Figure 2:
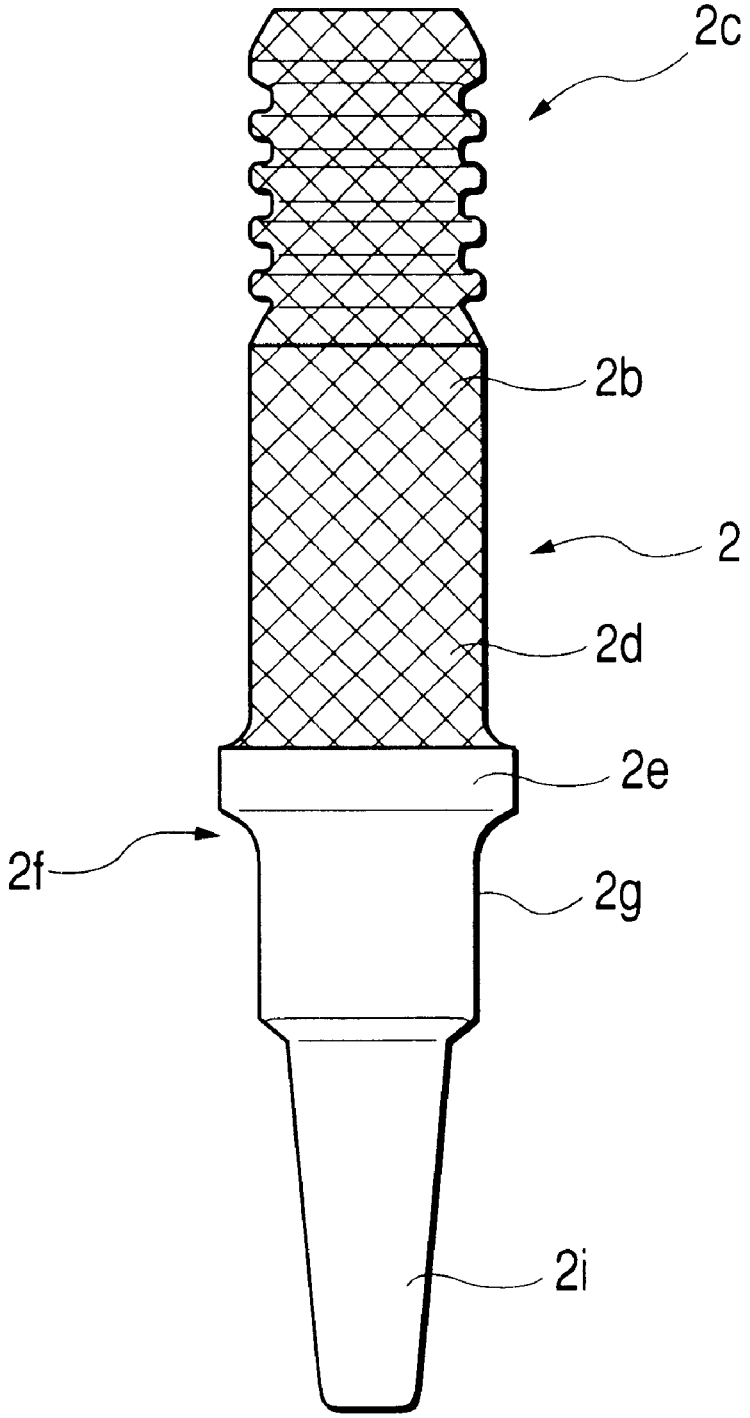
FIG. 2 is a front view showing an external appearance of the insulator together with the glaze layer.

As shown in FIG. 2, the glaze layer 2*d* is formed on the outer surface of the insulator 2, more specifically, on the outer peripheral surface of the rear portion 2*b* inclusive of the corrugated part 2*c*. The glaze layer 2*d* has a thickness of 7 to 150 $\mu$m, preferably 10 to 50 $\mu$m. As shown in FIG. 1, the glaze layer 2*d* formed on the rear portion 2*b* extends in the front direction farther from the rear end of the metal shell 1 to a predetermined length, while the rear side extends till the rear end edge of the rear portion 2*b*.

The glaze layer 2*d* has any one of the compositions explained in the columns of the means for solving the problems, works and effects. As the critical meaning in the composition range of each component has been referred to in detail, no repetition will be made herein. The thickness tg (average value) of the glaze layer 2*d* on the outer circumference of the base of the rear portion 2*b* (the cylindrical and non-corrugated outer circumference part 2*c* projecting downward from the metal shell 1) is 7 to 50 $\mu$m. The corrugations 2*c* may be omitted. In this case, the average thickness of the glaze layer 2*d* on the area from the rear end of the metal shell 1 up to 50% of the projecting length LQ of the main part 1*b* is taken as tg.

The ground electrode 4 and the core 3*a* of the center electrode 3 are made of an Ni alloy. The core 3*a* of the center electrode 3 is buried inside with a core 3*b* comprising Cu or Cu alloy for accelerating heat dissipation. An ignition part 31 and an opposite ignition part 32 are mainly made of a noble metal alloy based on one kind or more of Ir, Pt and Rh. The core 3*a* of the center electrode 3 is reduced in diameter at a front end and is formed to be flat at the front face, to which a disk made of the alloy composing the ignition part is superposed, and the periphery of the joint is welded by a laser welding, electron beam welding, or resistance welding to form a welded part W, thereby constructing the ignition part 31. The opposite ignition part 32 positions a tip to the ground electrode 4 at the position facing the ignition part 31, and the periphery of the joint is welded to form a similar welded part W along an outer edge part. The tips are prepared by a molten metal comprising alloying components at a predetermined ratio or forming and sintering an alloy powder or a mixed powder of metals having a predetermined ratio. At least one of the ignition part 31 and the opposite ignition part 32 may be omitted.

The spark plug 100 can be produced as follows. In preparing the insulator 2, an alumina powder is mixed with raw material powders of a Si component, Ca component, Mg component, Ba component, and B component in such a mixing ratio as to give the aforementioned composition after sintering, and the mixed powder is mixed with a prescribed amount of a binder (e.g., PVA) and a water to prepare a slurry. The raw material powders include, for example, $SiO_2$ powder as the Si component, $CaCO_3$ powder as the Ca component, MgO powder as the Mg component, $BaCO_3$ as the Ba component, and $H_3PO_3$ as to the B component. $H_3BO_3$ may be added in the form of a solution.

A slurry is spray-dried into granules for forming a base, and the base forming granules are rubber-pressed into a pressed body a prototype of the insulator The formed body is processed on an outer side by grinding to the contour of the insulator 2 shown in FIG. 1, and then baked 1400 to 1600° C. to obtain the insulator 2.

The glaze slurry is prepared as follows.

Raw material powders as sources of Si, B, Zn, Ba, and alkaline components (Na, K, Li) (for example, $SiO_2$ powder for the Si component, $H_3PO_3$ powder for the B component, ZnO powder for the Zn component, $BaCO_3$ powder for the Ba component, $Na_2CO_3$ powder for the Na component, $K_2CO_3$ powder for the k component, and $Li_2CO_3$ powder for the Li component) are mixed for obtaining a predetermined composition. The mixed powder is heated and melted at 1000 to 1500° C., and thrown into the water to rapidly cool for vitrification, followed by grinding to prepare a glaze fritz. The glaze fritz is mixed with appropriate amounts of clay mineral, such as kaolin or gairome clay, and organic binder, and the water is added thereto to prepare the glaze slurry.

Figure 5:
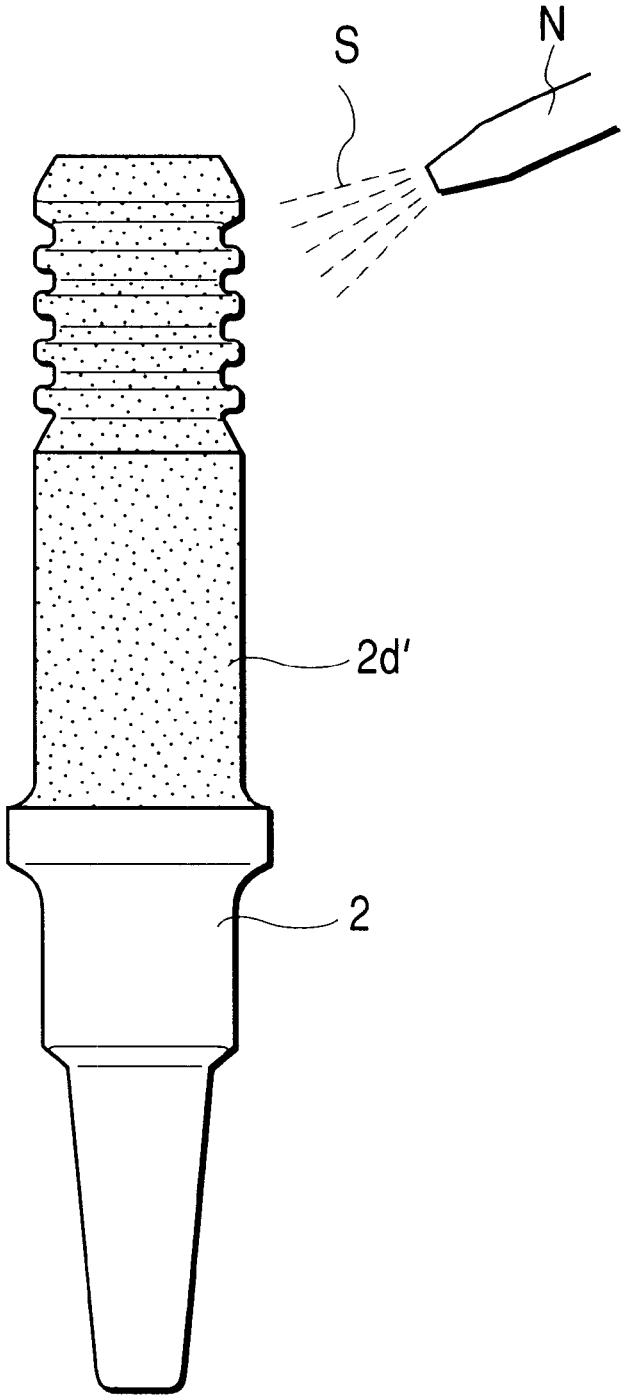
FIG. 5 is an explanatory view of the forming step of coating the slurry of the glaze.

As shown in FIG. 5, the glaze slurry S is sprayed from a nozzle N to coat a requisite surface of the insulator 2, thereby to form a glaze slurry coated layer 2*d'* as the piled layer of the glaze powder.

Figure 6D:
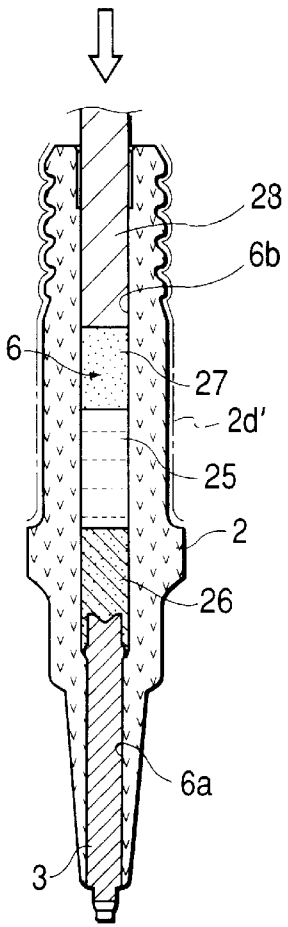
FIGS. 6A to 6D are explanatory views of the gas sealing step.
Figure 6C:
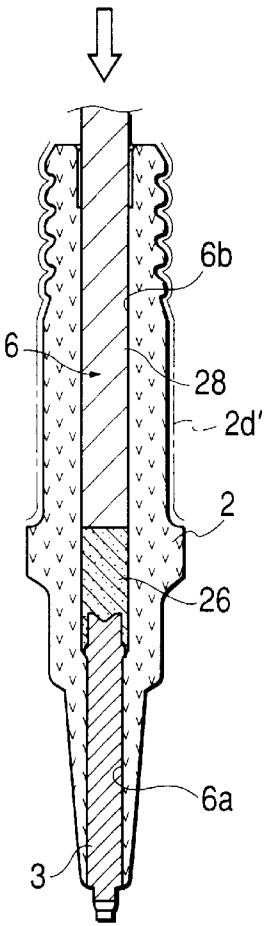
Figure 6B:
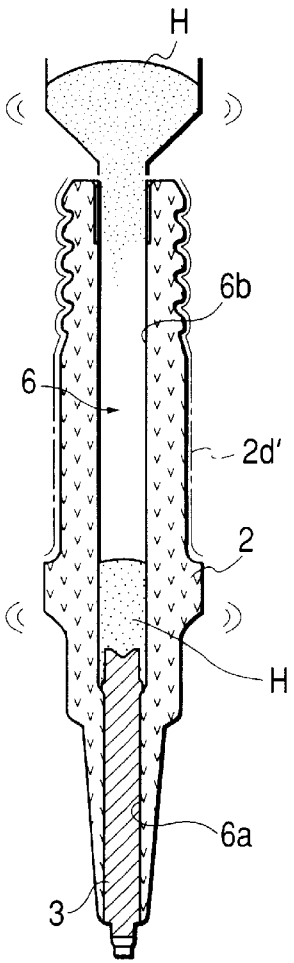
Figure 6A:
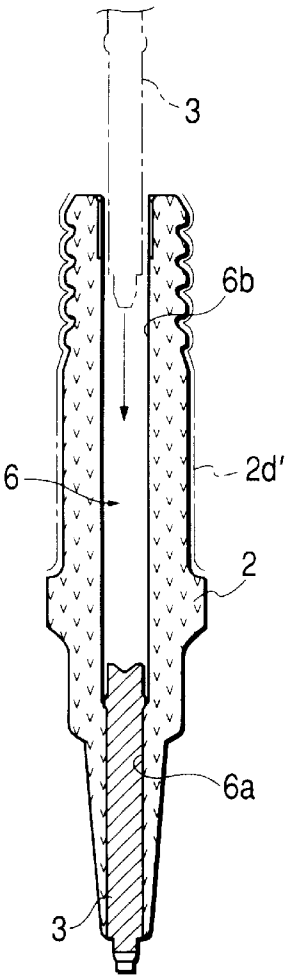

The center electrode 3 and the terminal metal fixture 13 are fitted in the insulator 2 formed with the glaze slurry coated layer 2*d'* as well as the resistor 15 and the electrically conductive glass seal layers 16, 17 are formed as follows. As shown in FIG. 6A, the center electrode 3 is inserted into the first portion 6*a* of the through-hole 6. A conductive glass powder H is filled as shown in FIG. 6B. The powder H is preliminary compressed by pressing a press bar 28 into the through-hole 6 to form a first conductive glass powder layer 26. A raw material powder for a resistor composition is filled and preliminary compressed in the same manner, so that, as shown in FIG. 8D, the first conductive glass powder 26, the resistor composition powder layer 25 and a second conductive glass powder layer 27 are laminated from the center electrode 3 (lower side) into the through-hole 6.

Figure 7A:
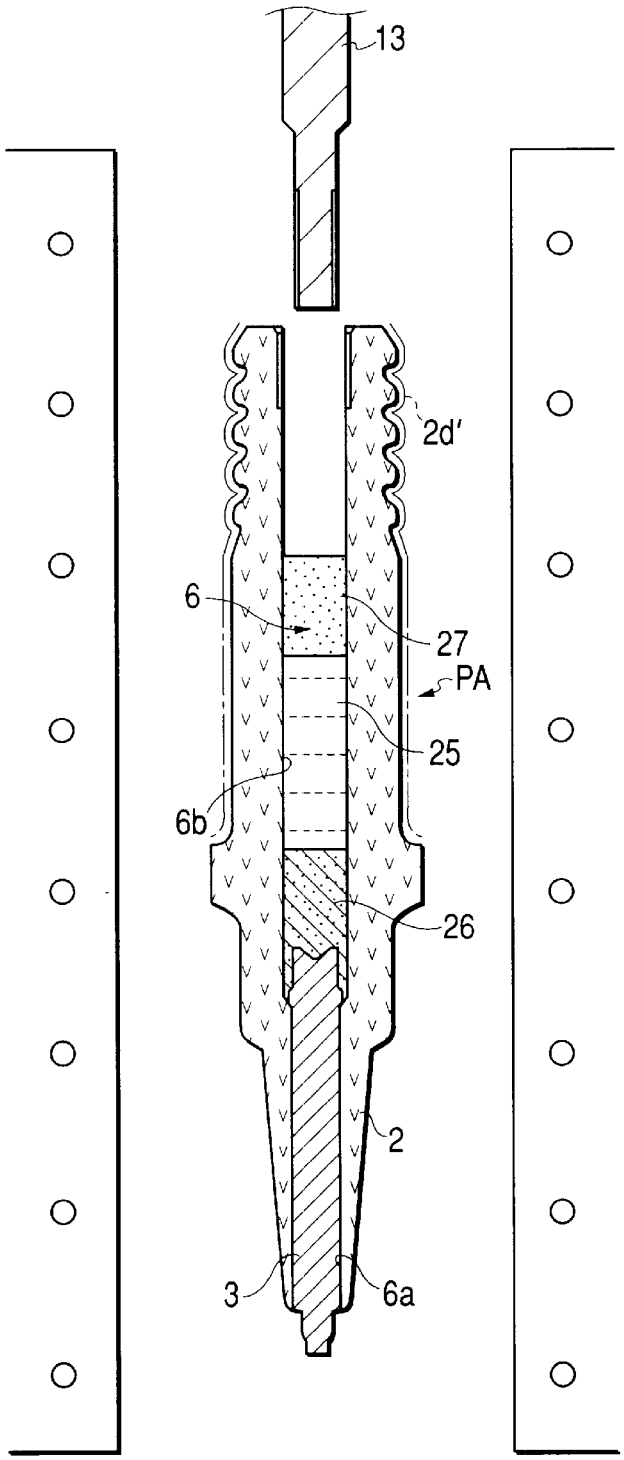
FIGS. 7A and 7B are explanatory views continuing from FIGS. 6A to 6D.

An assembled structure PA is formed where the terminal metal fixture 13 is disposed from the upper part into the through-hole 6 as shown in FIG. 7A. The assembled structure PA is put into a heating oven and heated at a predetermined temperature of 800 to 950° C. being above the glass softening point, and then the terminal metal fixture 13 is pressed into the through-hole 6 from a side opposite to the center electrode 3 so as to press the superposed layers 25 to 27 in the axial direction. Thereby, as seen in FIG. 9B, the layers are each compressed and sintered to become a conductive glass seal layer 16, a resistor 15, and a conductive glass seal layer 17 (the above is the glass sealing step).

Figure 7B:
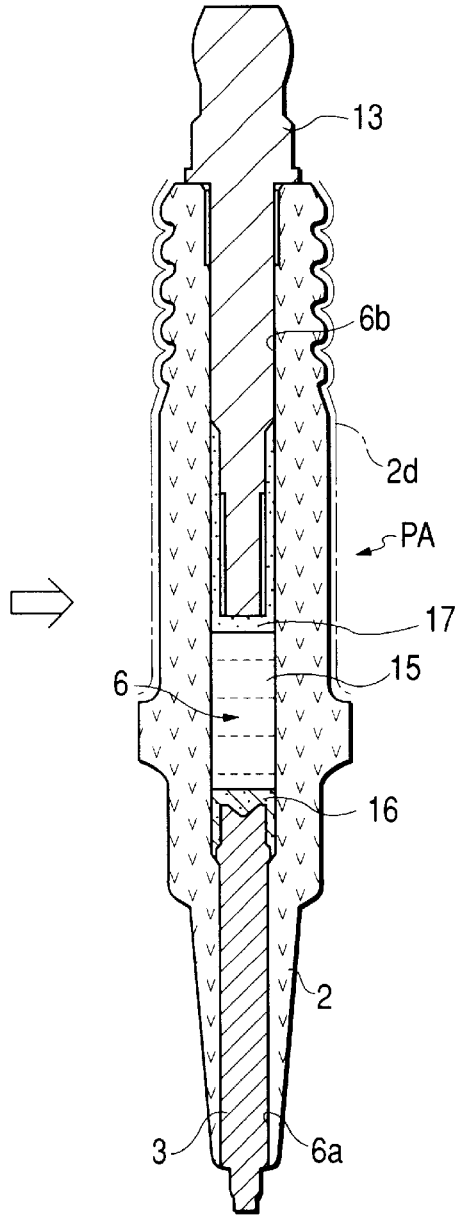

If the softening point of the glaze powder contained in the glaze slurry coated layer 2*d'* is set to be 600 to 700° C., the layer 2*d'* can be baked as shown in FIG. 7, at the same time as the heating in the above glass sealing step, into the glaze layer 2*d*. Since the heating temperature of the glass sealing step is selected from the relatively low temperature of 800 to 950° C., oxidation to surfaces of the center electrode 3 and the terminal metal fixture 13 can be made less.

If a burner type gas furnace is used as the heating oven (which also serves as the glaze baking oven), a heating atmosphere contains relatively much steam as a combustion product. If the glaze composition containing the B component 40 mol % or less is used, the fluidity when baking the glaze can be secured even in such an atmosphere, and it is possible to form the glaze layer of smooth and homogeneous substance and excellent in the insulation.

After the glass sealing step, the metal shell 1, the ground electrode 4 and others are fitted on the structure PA to complete spark plug 100 shown in FIG. 1. The spark plug 100 is screwed into an engine block using the thread 7 thereof and used as a spark source to ignite an air/fuel mixture supplied to a combustion chamber. A high-tension cable or an ignition coil is connected to the spark plug 100 by means of a rubber cap RC (comprising, e.g., silicone rubber) . The rubber cap RC has a smaller hole diameter than the outer diameter D1 (FIG. 3) of the rear portion 2*b* by about 0.5 to 1.0 mm. The rear portion 2*b* is pressed into the rubber cap while elastically expanding the hole until it is covered therewith to its base.

As a result, the rubber cap RC comes into close contact with the outer surface of the rear portion 2*b* to function as an insulating cover for preventing flashover.

By the way, the spark plug of the invention is not limited to the type shown in FIG. 1, but the tip of the ground electrode 4 is made face the side of the center electrode 3 to form an ignition gap g. Further, as shown in FIG. 5, a semi-planar discharge type spark plug is also useful where the front end of the insulator 2 is advanced between the side of the center electrode 3 and the front end of the ground electrode 4.

[Experimental Example]

For confirmation of the effects according to the invention, the following experiments were carried out.

The insulator 2 was made as follows. Alumina powder (alumina content: 95 mol %; Na content (as $Na_2O$) : 0.1 mol %; average particle size: 3.0 μm) was mixed at a predetermined mixing ratio with $SiO_2$ (purity: 99.5%; average particle size: 1.5 μm), $CaCO_3$ (purity: 99.9%; average particle size: 2.0 μm), MgO (purity: 99.5%; average particle size: 2 μm) $BaCO_3$ (purity: 99.5%; average particle size: 1.5 μm), $H_3BO_3$ (purity: 99.0%; average particle size 1.5 μm), and ZnO (purity: 99.5%, average particle size: 2.0 μm). To 100 parts by weight of the resulting mixed powder were added 3 mass parts of FVA as a hydrophilic binder and 103 mass parts of water, and the mixture was kneaded to prepare a slurry.

The resulting slurry was spray-dried into spherical granules, which were sieved to obtain fraction of 50 to 100 μm. The granules were formed under a pressure of 50 MPa by a known rubber-pressing method. The outer surface of the formed body was machined with the grinder into a predetermined figure and baked at 1550° C. to obtain the insulator 2. The X-ray fluorescence analysis revealed that the insulator 2 had the following composition.

| | |
|---|---|
| Al component (as $Al_2O_3$): | 94.9 mol %; |
| Si component (as SiO2): | 2.4 mol %; |
| Ca component (as CaO): | 1.9 mol %; |
| Mg component (as MgO): | 0.1 mol %; |
| Ba component (as BaO): | 0.4 mol %; and |
| B component (as B2O3): | 0.3 mol %. |

The insulator 2 shown in FIG. 3A has the following dimensions. L1=ca.60 mm, L2=ca.8 mm, L3=ca.14 mm, D1=ca.10 mm, D2=ca.13 mm, D3=ca.7 mm, D4=5.5, D5=4.5 mm, D6=4 mm, D7=2.6 mm, t1=1.5 mm, t2=1.45 mm, t3=1.25 mm, and tA=1.35 mm. In FIG. 1, a length LQ of the portion 2*k* of the insulator 2 which projects over the rear end of the metal shell 1, is 25 mm. In a vertical cross section containing the center axial line O of the insulator 2 on the outer contour of the projecting portion 2*k* of the insulator 2, the length LP of the portion 2*k* as measured along the profile of the insulator 2 is 29 mm, starting from a position corresponding to the rear end of the metal shell 1, through the surface of the corrugations 2*c*, to the rear end of the insulator 2.

Next, the glaze slurry was prepared as follows. $SiO_2$ powder (purity: 99.5%) , $Al_2O_3$ powder (purity: 99.5%), $H_3BO_3$ powder (purity: 98.5%), $Na_2CO_3$ powder (purity: 99.5%), $K_2CO_3$ powder (purity: 99%), $Li_2CO_3$ powder (purity: 99%), $BaSO_4$ powder (purity: 99.5%), $SrCO_3$ powder (purity: 99%), ZnO powder (purity: 99.5%), $MoO_3$ powder (purity: 99%), CaO powder (purity: 99.5%), $TiO_2$ powder (purity: 99.5%), $ZrO_2$ powder (purity: 99.5%), $HfO_2$ powder (purity: 99% ), MgO powder (purity: 99.5%), and $Sb_2O_5$ powder (purity: 99%) were mixed. The mixture was melted 1000 to 1500° C., and the melt was poured into the water and rapidly cooled for vitrification, followed by grinding in an alumina pot mill to powder of 50 μm or smaller. Three parts by weight of New Zealand kaolin and 2 parts by weight of PVA as an organic binder were mixed into 100 parts by weight of the glaze powder, and the mixture was kneaded with 100 parts by weight of the water to prepare the glaze slurry.

The glaze slurry was sprayed on the insulator 2 from the spray nozzle as illustrated in FIG. 5, and dried to form the coated layer 2*d'* of the glaze slurry having a coated thickness of about 100 μm. Several kinds of the spark plug 100 shown in FIG. 1 were produced by using the insulator 2. The outer diameter of the thread 7 was 14 mm. The resistor 15 was made of the mixed powder consisting of $B_2O_3$—$SiO_2$—

BaO—$LiO_2$ glass powder, $ZrO_2$ powder, $O_2$ carbon black powder, $TiO_2$ powder, and metallic Al powder. The electrically conductive glass seal layers 16, 17 were made of the mixed powder consisting of $B_2O_3$—$Si_{O2}$—$Na_2O$ glass powder, Cupowder, Fepowder, and Fe—B powder. The heating temperature for the glass sealing, i.e., the glaze baking temperature was set at 900° C.

On the other hand, such glaze samples were produced which were not pulverized but solidified in block. The block-like sample was confirmed by the X-ray diffraction to be a vitrified (amorphous) state.

The experiments were performed as follows.

1) Chemical composition analysis

The X-ray fluorescence analysis was conducted. The analyzed value per each sample (in terms of oxide) was shown in Tables 1 to 3. The analytical results obtained by EPMA on the glaze layer 2*d* formed on the insulator were almost in agreement with the results measured with the block-like samples.

2) Thermal expansion coefficient

The specimen of 5 mm×5 mm×5 mm was cut out from the block-like sample, and measured with the known dilatometer method at the temperature ranging 20 to 350° C. The same measurement was made at the same size of the specimen cut out from the insulator 2. As a result, the value was $73\times10^{-7}$/° C.

3) Softening point

The powder sample weighing 50 mg was subjected to the differential thermal analysis, and the heating was measured from a room temperature. The second endothermic peal was taken as the softening point.

Figure 4:
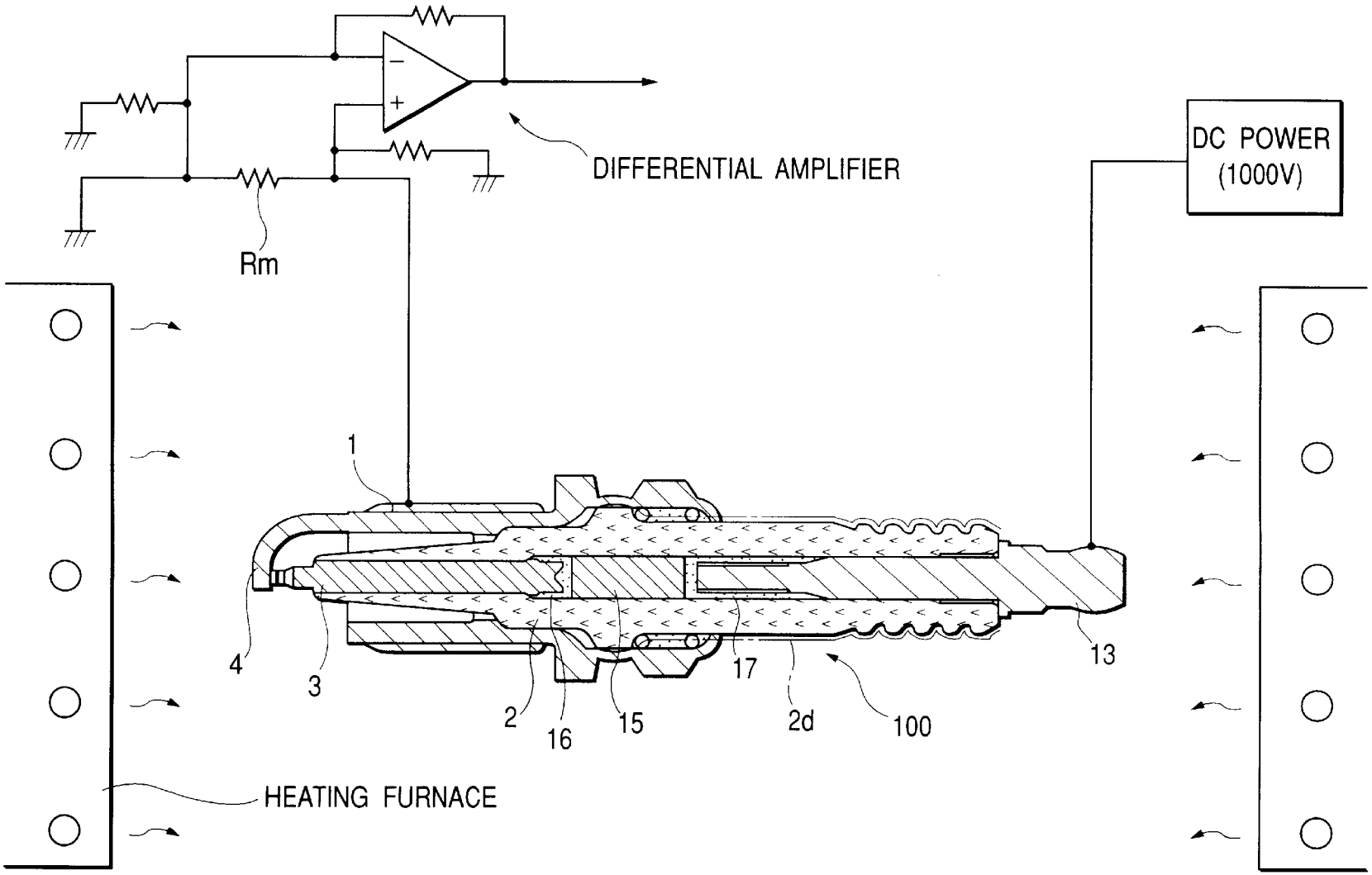
FIG. 4 is an explanatory view showing the measuring method of the insulation resistant value of the spark plug.

With respect to the respective spark plugs, the insulation resistance at 500° C. was evaluated at the applied voltage 1000 V through the process explained with reference to FIG. 4. Further, the appearance of the glaze layer 2*d* formed on the insulator 2 was visually observed. The film thickness of the glaze layer on the outer circumference of the base edge part of the insulator was measured in the cross section by the SEM observation.

Figure 8:
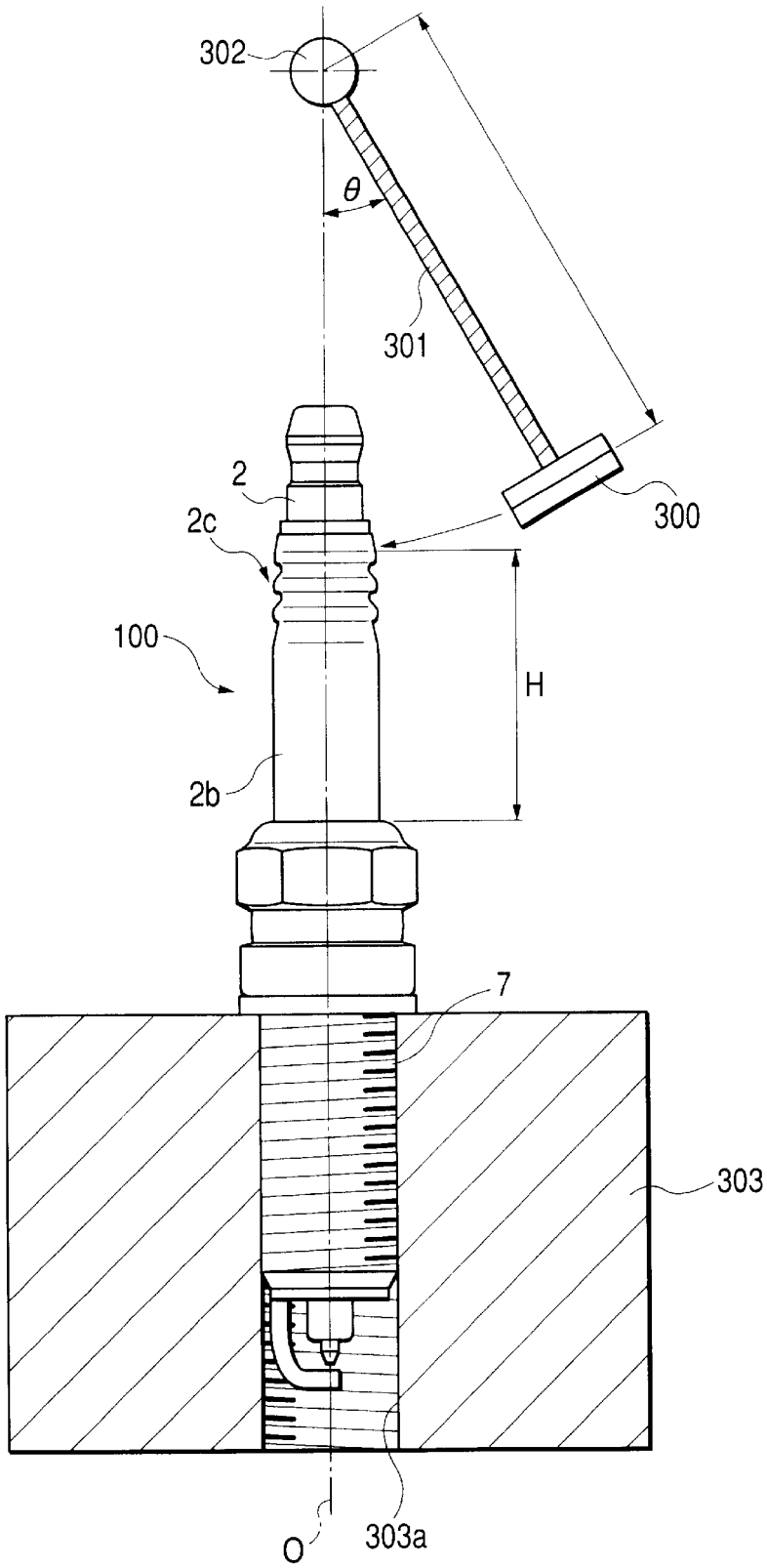
FIG. 8 is a view showing the method of measuring values of impact endurance angles.

The respective test articles were subjected to the impact test. As seen in FIG. 8, an attaching screw portion 7 of the spark plug 100 was urged into a screw hole 303*a* of the test article fixing bed 303 and fixed there such that the main body part 2*b* of the insulator 2 projected upward. At a more upper part of the main body part 2*b*, an arm 301 having a steel made hammer 300 at a front end was turnably provided to an axial fulcrum 302 located the enter axial line O of the insulator 2. The arm 301 had 330 mm length and the hammer 300 had 1.13 kg weight. The axial fulcrum 302 was positioned such that a position of the hammer when it was brought down to a rear-side main body part 2*b* was 1 mm (so as to correspond to a first mountain position of corrugations 2*c*) as a distance in the vertical direction from the backward face of the insulator 2. The hammer 300 was brought up such that a turning angle of the arm 301 was as predetermined angle from the center axial line O, and when operation of bringing down the hammer owing to free dropping toward the backward part of the rear-side main body part 2*b* of the insulator was repeated as stepwise making larger at distance of 2 degree, impact endurance angle θ demanded as a limit angle when cracks appeared in the insulator.

Results are shown in attached Table.

[Example A]

| Components in terms of oxides (mol %) | 1 | 2 | 2' | 3 | A | B | C | D |
|---|---|---|---|---|---|---|---|---|
| $SiO_2$ | 33.0 | 33.0 | 33.0 | 33.0 | 33.0 | 33.0 | 33.0 | 33.0 |
| $Al_2O_3$ | 3.0 | 3.0 | 3.0 | 3.0 | 3.0 | 3.0 | 3.0 | 3.0 |
| $B_2O_3$ | 34.0 | 34.0 | 34.0 | 34.0 | 33.0 | 33.0 | 33.0 | 33.0 |
| $Na_2O$ | 1.0 | 1.0 | 1.0 | 1.0 | 1.0 | 1.0 | 1.0 | 1.0 |
| $K_2O$ | 5.0 | 5.0 | 4.0 | 5.0 | 4.0 | 4.0 | 4.0 | 4.0 |
| $Li_2O$ | 2.0 | 2.0 | 3.0 | 2.0 | 3.0 | 3.0 | 3.0 | 3.0 |
| SrO | | | 2.0 | | 2.0 | 2.0 | 2.0 | 2.0 |
| BaO | 4.0 | 4.0 | 2.0 | 4.0 | 2.0 | 2.0 | 2.0 | 2.0 |
| ZnO | 18.0 | 18.0 | 18.0 | 18.0 | 18.0 | 18.0 | 18.0 | 18.0 |
| $MoO_3$ | | | | | 1.0 | | | |
| $Fe_2O_3$ | | | | | | 1.0 | | |
| $WO_3$ | | | | | | | 1.0 | |
| $Ni_3O_4$ | | | | | | | | 1.0 |
| $MnO_2$ | | | | | | | | |
| CaO | | | | | | | | |
| $ZrO_2$ | | | | | | | | |
| $TiO_2$ | | | | | | | | |
| $HfO_2$ | | | | | | | | |
| MgO | | | | | | | | |
| $Bi_2O_3$ | | | | | | | | |
| $SnO_2$ | | | | | | | | |
| $P_2O_5$ | | | | | | | | |
| CuO | | | | | | | | |
| $CeO_2$ | | | | | | | | |
| $Cr_2O_3$ | | | | | | | | |
| $Sb_2O_5$ | | | | | | | | |
| Total | 100.0 | 100.0 | 100.0 | 100.0 | 100.0 | 100.0 | 100.0 | 100.0 |
| $K_2O + Na_2O + Li_2O$ | 8.0 | 8.0 | 8.0 | 8.0 | 8.0 | 8.0 | 8.0 | 8.0 |
| ZnO + BaO + SrO | 22.0 | 22.0 | 22.0 | 22.0 | 22.0 | 22.0 | 22.0 | 22.0 |
| $B_2O_3$/ (ZnO + BaO + SrO) | 1/5 | 1.5 | 1.5 | 1.5 | 1.5 | 1.5 | 1.5 | 1.5 |
| ZnO > BaO + SrO | | | | | | | | |
| CaO + MgO | | | | | | | | |

-continued

| Components in terms of oxides (mol %) | 1 | 2 | 2' | 3 | A | B | C | D |
|---|---|---|---|---|---|---|---|---|
| Expansion Coefficient ($\times 10^7$) | 68 | 68 | 70 | 68 | 69 | 69 | 69 | 69 |
| Softening point (° C.) | 640 | 640 | 630 | 640 | 645 | 645 | 645 | 645 |
| Glaze film thickness ($\mu$m) | 40 | 15 | 15 | 5 | 15 | 15 | 15 | 15 |
| External appearance (Glaze baked condition) | Good | Good | Good | Good | Good | Good | Good | Good |
| Angle value of shock endurance (° C.) | 56 | 46 | 44 | 36 | 44 | 44 | 44 | 44 |
| Insulation resistance value at 500° C. (MΩ) | 800 | 950 | 700 | 1000 | 700 | 700 | 700 | 700 |
| Note | | | | Poor appearance | | | | |

[ExampleB]

| Components in terms of oxides (mol %) | E | F | G | H | I | J | K | L |
|---|---|---|---|---|---|---|---|---|
| $SiO_2$ | 33.0 | 33.0 | 33.0 | 33.0 | 33.0 | 33.0 | 33.0 | 33.0 |
| $Al_2O_3$ | 3.0 | 3.0 | 3.0 | 3.0 | 3.0 | 3.0 | 3.0 | 3.0 |
| $B_2O_3$ | 33.0 | 33.0 | 33.0 | 33.0 | 33.0 | 33.0 | 33.0 | 33.0 |
| $Na_2O$ | 1.0 | 1.0 | 1.0 | 1.0 | 1.0 | 1.0 | 1.0 | 1.0 |
| $K_2O$ | 4.0 | 4.0 | 4.0 | 4.0 | 4.0 | 4.0 | 4.0 | 4.0 |
| $Li_2O$ | 3.0 | 3.0 | 3.0 | 3.0 | 3.0 | 3.0 | 3.0 | 3.0 |
| SrO | 2.0 | 2.0 | 2.0 | 2.0 | 2.0 | 2.0 | 2.0 | 2.0 |
| BaO | 2.0 | 2.0 | 2.0 | 2.0 | 2.0 | 2.0 | 2.0 | 2.0 |
| ZnO | 18.0 | 18.0 | 18.0 | 18.0 | 18.0 | 18.0 | 18.0 | 18.0 |
| $MoO_3$ | | | | | | | | |
| $Fe_2O_3$ | | | | | | | | |
| $WO_3$ | | | | | | | | |
| $Ni_3O_4$ | | | | | | | | |
| $MnO_2$ | 1.0 | | | | | | | |
| CaO | | | | | | | | |
| $ZrO_2$ | | | | | | | | |
| $TiO_2$ | | | | | | | | |
| $HfO_2$ | | | | | | | | |
| MgO | | | | | | | | |
| $Bi_2O_3$ | | 1.0 | | | | | | |
| $SnO_2$ | | | 1.0 | | | | | |
| $P_2O_5$ | | | | 1.0 | | | | |
| CuO | | | | | 1.0 | | | |
| $CeO_2$ | | | | | | 1.0 | | |
| $Cr_2O_3$ | | | | | | | 1.0 | |
| $Sb_2O_5$ | | | | | | | | 1.0 |
| Total | 100.0 | 100.0 | 100.0 | 100.0 | 100.0 | 100.0 | 100.0 | 100.0 |
| $K_2O + Na_2O + Li_2O$ | 8.0 | 8.0 | 8.0 | 8.0 | 8.0 | 8.0 | 8.0 | 8.0 |
| ZnO + BaO + SrO | 22.0 | 22.0 | 22.0 | 22.0 | 22.0 | 22.0 | 22.0 | 22.0 |
| $B_2O_3$/(ZnO + BaO + SrO) | 1.5 | 1.5 | 1.5 | 1.5 | 1.5 | 1.5 | 1.5 | 1.5 |
| ZnO > BaO + SrO | | | | | | | | |
| CaO + MgO | | | | | | | | |
| Expansion Coefficient ($\times 10^7$) | 69 | 69 | 69 | 69 | 69 | 69 | 69 | 69 |
| Softening point (° C.) | 645 | 630 | 640 | 640 | 640 | 640 | 640 | 635 |
| Glaze film thickness ($\mu$m) | 15 | 15 | 15 | 15 | 15 | 15 | 15 | 15 |
| External appearance (Glaze | Good | Good | Good | Good | Good | Good | Good | Good |

-continued

| Components in terms of oxides (mol %) | E | F | G | H | I | J | K | L |
|---|---|---|---|---|---|---|---|---|
| baked condition) | | | | | | | | |
| Angle value of shock endurance (° C.) | 44 | 44 | 44 | 44 | 44 | 44 | 44 | 44 |
| Insulation resistance value at 500° C. (MΩ) | 700 | 700 | 700 | 700 | 700 | 700 | 700 | 700 |
| Note | | | | | | | | |

[Example C]

| Components in terms of oxides (mol %) | M | N | P | Q | 4 | 5 | 6 |
|---|---|---|---|---|---|---|---|
| $SiO_2$ | 33.0 | 33.0 | 33.0 | 33.0 | 33.0 | 33.0 | 33.0 |
| $Al_2O_3$ | 3.0 | 3.0 | 3.0 | 3.0 | 3.0 | 3.0 | 3.0 |
| $B_2O_3$ | 31.5 | 32.0 | 32.0 | 32.0 | 34.0 | 34.0 | 28.5 |
| $Na_2O$ | 1.0 | 1.0 | 1.0 | 1.0 | 1.0 | | 1.0 |
| $K_2O$ | 4.0 | 4.0 | 4.0 | 4.0 | 5.0 | 6.0 | 5.0 |
| $Li_2O$ | 3.0 | 3.0 | 3.0 | 3.0 | 2.0 | 2.0 | 2.0 |
| SrO | 2.0 | 2.0 | 2.0 | 2.0 | | | 8.0 |
| BaO | 2.0 | 2.0 | 2.0 | 2.0 | 4.0 | 4.0 | |
| ZnO | 18.0 | 18.0 | 18.0 | 18.0 | 18.0 | 18.0 | 18.0 |
| $MoO_3$ | 1.0 | 1.0 | 1.0 | 1.0 | | | 1.0 |
| $Fe_2O_3$ | | | | | | | |
| $WO_3$ | | | | | | | |
| $Ni_3O_4$ | | | | | | | |
| $MnO_2$ | | | | | | | |
| CaO | | | | | | | |
| $ZrO_2$ | 0.5 | 1.0 | | | | | |
| $TiO_2$ | 0.5 | | 1.0 | | | | |
| $HfO_2$ | | | | 1.0 | | | |
| MgO | | | | | | | |
| $Bi_2O_3$ | | | | | | | |
| $SnO_2$ | | | | | | | |
| $P_2O_5$ | | | | | | | |
| CuO | | | | | | | |
| $CeO_2$ | | | | | | | |
| $Cr_2O_3$ | | | | | | | |
| $Sb_2O_5$ | 0.5 | | | | | | 0.5 |
| Total | 100.0 | 100.0 | 100.0 | 100.0 | 100.0 | 100.0 | 100.0 |
| $K_2O + Na_2O + Li_2O$ | 8.0 | 8.0 | 8.0 | 8.0 | 8.0 | 8.0 | 8.0 |
| ZnO + BaO + SrO | 22.0 | 22.0 | 22.0 | 22.0 | 22.0 | 22.0 | 26.0 |
| $B_2O_3$/(ZnO + BaO + SrO) | 1.4 | 1.5 | 1.5 | 1.5 | 1.5 | 1.5 | 1.1 |
| ZnO > BaO + SrO | | | | | | | |
| CaO + MgO | | | | | | | |
| Expansion Coefficient ($\times 10^7$) | 70 | 70 | 70 | 70 | 68 | 69 | 72 |
| Softening point (° C.) | 640 | 640 | 640 | 640 | 640 | 642 | 650 |
| Glaze film thickness (μm) | 15 | 15 | 15 | 15 | 70 | 40 | 40 |
| External appearance (Glaze baked condition) | Good | Good | Good | Good | Good | Good | Good |
| Angle value of shock endurance (° C.) | 44 | 44 | 44 | 44 | 40 | 54 | 52 |
| Insulation resistance value at 500° C. (MΩ) | 700 | 700 | 700 | 700 | 650 | 850 | 900 |
| Note | | | | | | | |

[Example D]

| Components in terms of oxides (mol %) | 7* | 8* | 9 | 10 | 11* |
|---|---|---|---|---|---|
| $SiO_2$ | 28.0 | 28.0 | 24.0 | 24.0 | 17.0 |
| $Al_2O_3$ | 0.0 | 6.0 | 1.0 | 1.0 | 0.5 |
| $B_2O_3$ | 24.0 | 24.0 | 22.0 | 22.0 | 21.0 |
| $Na_2O$ | 1.0 | 1.0 | 1.0 | 1.0 | 1.0 |
| $K_2O$ | 5.0 | 5.0 | 5.0 | 5.0 | 4.0 |
| $Li_2O$ | 2.0 | 2.0 | 2.0 | 2.0 | 1.0 |
| SrO | 7.0 | 7.0 | | | |
| BaO | 12.0 | 9.0 | 14.0 | 26.0 | 40.0 |
| ZnO | 19.0 | 16.0 | 26.0 | 14.0 | 14.5 |
| $MoO_3$ | | | | | |
| $Fe_2O_3$ | | | | | |
| $WO_3$ | | | | | |
| $Ni_3O_4$ | | | | | |
| $MnO_2$ | | | | | |
| CaO | 1.0 | 1.0 | | 2.0 | |
| $ZrO_2$ | 1.0 | 1.0 | | | |
| $TiO_2$ | | | 2.0 | | |
| $HfO_2$ | | | | | |
| MgO | | | 3.0 | 3.0 | 1.0 |
| $Bi_2O_3$ | | | | | |
| $SnO_2$ | | | | | |
| $P_2O_5$ | | | | | |
| CuO | | | | | |
| $CeO_2$ | | | | | |
| $Cr_2O_3$ | | | | | |
| $Sb_2O_5$ | | | | | |
| Total | 100.0 | 100.0 | 100.0 | 100.0 | 100.0 |
| $K_2O + Na_2O + Li_2O$ | 8.0 | 8.0 | 8.0 | 8.0 | 6.0 |
| ZnO + BaO + SrO | 38.0 | 32.0 | 40.0 | 40.0 | 54.5 |
| $B_2O_3$/(ZnO + BaO + SrO) | 0.6 | 0.8 | 0.6 | 0.6 | 0.4 |
| ZnO > BaO + SrO | | | | ○ | ○ |
| CaO + MgO | 1.0 | 1.0 | 3.0 | 5.0 | 1.0 |
| Expansion Coefficient ($\times 10^7$) | 78 | 76 | 70 | 80 | 87 |
| Softening point (° C.) | 630 | 640 | 615 | 630 | 610 |
| Glaze film thickness (μm) | 40 | 40 | 40 | 40 | 40 |
| External appearance (Glaze baked condition) | Devitrification | Mat shape (No luster) | Slight devitrification | Good | Devitrification |
| Angle value of shock endurance (° C.) | 30 | 48 | 54 | 36 | 26 |
| Insulation resistance value at 500° C. (MΩ) | 700 | 1000 | 500 | 900 | 1000 |
| Note | | | | | |

[Example E]

| Components in terms of oxides (mol %) | 12 | 13* | 14* | 15 | 16* | 17* |
|---|---|---|---|---|---|---|
| $SiO_2$ | 22.0 | 35,0 | 33.0 | 37.5 | 33.0 | 12.0 |
| $Al_2O_3$ | 0.5 | 2.0 | 1.0 | 1.0 | 1.0 | 3.0 |
| $B_2O_3$ | 22.0 | 37.0 | 32.0 | 28.0 | 32.0 | 34.0 |
| $Na_2O$ | 1.0 | 1.0 | 1.0 | 4.0 | 2.0 | 1.0 |
| $K_2O$ | 5.0 | 5.0 | 1.5 | 4.0 | 4.0 | 5.0 |
| $Li_2O$ | 2.0 | 2.0 | 7.0 | 0.5 | 5.0 | 2.0 |
| SrO | | 2.0 | | | | 3.0 |
| BaO | 29.0 | 7.0 | 4.0 | 7.0 | 4.0 | 15.0 |
| ZnO | 17.5 | 8.0 | 18.0 | 18.0 | 18.0 | 25.0 |
| $MoO_3$ | | 1.0 | | | | |
| $Fe_2O_3$ | | | | | | |
| $WO_3$ | | | | | | |
| $Ni_2O_4$ | | | | | | |
| $MnO_2$ | | | | | | |
| CaO | 1.0 | | 1.0 | | | |
| $ZrO_2$ | | | 0.5 | | | |
| $TiO_2$ | | | | | | |
| $HfO_2$ | | | | | | |
| MgO | | | 1.0 | | | |
| $Bi_2O_3$ | | | | | | |
| $SnO_2$ | | | | | | |
| $P_2O_5$ | | | | | | |
| CuO | | | | | | |
| $CeO_2$ | | | | | | |
| $Cr_2O_3$ | | | | | | |
| $Sb_2O_5$ | | | | | 1.0 | |
| Total | 100.0 | 100.0 | 100.0 | 100.0 | 100.0 | 100.0 |
| $K_2O + Na_2O + Li_2O$ | 8.0 | 8.0 | 9.5 | 8.5 | 11.0 | 8.0 |
| ZnO + BaO + SrO | 46.5 | 17.0 | 22.0 | 25.0 | 22.0 | 43.0 |
| $B_2O_3$/(ZnO + BaO + SrO) | 0.5 | 2.2 | 1.5 | 1.1 | 1.5 | 0.8 |
| ZnO > BaO + SrO | ○ | ○ | | | | |
| CaO + MgO | 1.0 | 0.0 | 2.0 | 0.0 | 0.0 | 0.0 |
| Expansion Coefficient ($\times 10^7$) | 81 | 79 | 80 | 66 | 86 | 74 |
| Softening point (° C.) | 605 | 700 | 620 | 660 | 590 | 610 |
| Glaze film thickness (μm) | 40 | 40 | 40 | 40 | 40 | 40 |
| External appearance (Glaze baked condition) | Slight devitrification | Slightly insufficient melting | Good | Bubbles remaining | Good | Slight cracking |
| Angle value of shock endurance (° C.) | 34 | 30 | 40 | 34 | 30 | 46 |
| Insulation resistance value at 500° C. (MΩ) | 700 | 900 | 150 | 800 | 80 | 300 |
| Note | | | Bad insulation resistance | | Bad insulation resistance | |

[Example F]

| Components in terms of oxides (mol %) | 18 | 19* | 20* | 21* | 22* |
|---|---|---|---|---|---|
| $SiO_2$ | 44.8 | 61.8 | 20.0 | 30.0 | 33.0 |
| $Al_2O_3$ | 1.0 | 0.5 | 1.0 | 3.0 | 3.0 |
| $B_2O_3$ | 30.0 | 21.0 | 55.0 | 18.0 | 34.0 |
| $Na_2O$ | 2.0 | 1.5 | 1.0 | 1.0 | |
| $K_2O$ | 4.0 | 2.0 | 5.0 | 5.0 | 5.0 |

-continued

| Components in terms of oxides (mol %) | 18 | 19* | 20* | 21* | 22* |
|---|---|---|---|---|---|
| $Li_2O$ | 1.2 | 1.2 | 2.0 | 2.0 | 2.0 |
| SrO | | | | 5.0 | |
| BaO | 5.0 | 2.0 | 4.0 | 10.0 | 4.0 |
| ZnO | 11.0 | 10.0 | 12.0 | 25.0 | 16.0 |
| $MoO_3$ | | | | | |
| $Fe_2O_3$ | | | | | |

-continued

| Components in terms of oxides (mol %) | 18 | 19* | 20* | 21* | 22* |
|---|---|---|---|---|---|
| $WO_3$ | | | | | |
| $Ni_3O_4$ | | | | | |
| $MnO_2$ | | | | | |
| CaO | | | | | |
| $ZrO_2$ | 1.0 | | | 0.5 | |
| $TiO_2$ | | | | 0.5 | |
| $HfO_2$ | | | | | |
| MgO | | | | | $F_2$: 3.0 |
| $Bi_2O_3$ | | | | | |
| $SnO_2$ | | | | | |
| $P_2O_5$ | | | | | |
| CuO | | | | | |
| $CeO_2$ | | | | | |
| $Cr_2O_3$ | | | | | |
| $Sb_2O_5$ | | | | | |
| Total | 100.0 | 100.0 | 100.0 | 100.0 | 100.0 |
| $K_2O + Na_2O + Li_2O$ | 7.2 | 4.7 | 8.0 | 8.0 | 7.0 |
| ZnO + BaO + SrO | 16.0 | 12.0 | 16.0 | 40.0 | 20.0 |
| $B_2O_3$/(ZnO + BaO + SrO) | 1.9 | 1.8 | 3.4 | 0.5 | 1.7 |
| ZnO > BaO + SrO | | | | | |
| CaO + MgO | 0.0 | 0.0 | 0.0 | 0.0 | 0.0 |
| Expansion Coefficient ($\times 10^7$) | 70 | 64 | 66 | 70 | 69 |
| Softening point (° C.) | 655 | 750 | 615 | 730 | 620 |
| Glaze film thickness ($\mu$m) | 40 | 40 | 40 | 40 | 40 |
| External appearance (Glaze baked condition) | Good | Insuffi-cient melting | Slight crimping | Insuffi-cient melting | Much bubbles |
| Angle value of shock endurance (° C.) | 58 | 60 | 50 | 54 | 34 |
| Insulation resistance value at 500° C. (MΩ) | 900 | 1200 | 750 | 350 | 700 |
| Note | | | Bad water proof | | Shortening life of oven wall |

According to the results, depending on the compositions of the glaze of the invention, although no Pb is substantially contained, the glaze may be baked at relatively low temperatures, sufficient insulating properties are secured, and the outer appearance of the baked glaze faces are almost satisfied. In addition, the satisfactory impact endurance angle values are secured as 35 degree or more, and it is seen that the impact resistance of the insulator formed with the glaze layer is improved.

The entire disclosure of each and every foreign patent application from which the benefit of foreign priority has been claimed in the present application is incorporated herein by reference, as if fully set forth herein.

What is claimed is:

1. A spark plug comprising: a center electrode; a metal shell; an insulator comprising alumina ceramic and disposed between the center electrode and the metal shell, wherein at least part of the surface of the insulator is covered with a glaze layer comprising oxides, wherein the glaze layer comprises:

1 mol % or less of a Pb component in terms of PbO;

15 to 60 mol % of a Si component in terms of $SiO_2$;

22 to 50 mol % of a B component in terms of $B_2O_3$;

10 to 30 mol % of a Zn component in terms of ZnO;

0.5 to 35 mol % in total of at least one of Ba and Sr components in terms of BaO and SrO, respectively;

1 mol % or less of an F component;

0.1 to 5 mol % of an Al component in terms of $Al_2O_3$; and 5 to 10 mol % in total of at least one of alkaline metal component of Na, K and Li, in terms of $Na_2O$, $K_2O$, and $Li_2O$, respectively, wherein Li is essential, and the amount of the Li component is 1.1 to 6 mol % in terms of $Li_2O$, provided that Li/(Na+K+Li) is 0.2 to 0.5 in terms of oxides thereof.

2. The spark plug as set forth in claim 1, wherein the glaze layer contains 25 to 40 mol % of the Si component in terms of $SiO_2$, and 0.5 to 20 mol % in total of the at least one of the Ba and Sr components of in terms of BaO and SrO, respectively.

3. The spark plug as set forth in claim 1, wherein when the glaze layer contains the Zn component in an amount of NZnO (mol %) in terms of ZnO, the Ba component of NBaO (mol %) in terms of BaO, and the Sr component in an amount of NSrO (mol %) in terms of SrO, NZnO+NBaO+NSrO is 15 to 45 mol %.

4. The spark plug as set forth in claim 1, wherein when the glaze layer contains the Zn component in an amount of NZnO (mol %) in terms of ZnO, the Ba component in an amount of NBaO (mol %) in terms of BaO, and the Sr component in an amount of NSrO (mol %) in terms of SrO, NZnO>NBaO +NSrO.

5. The spark plug as set forth in claim 1, wherein when the glaze layer contains the B component in an amount of $NB_2O_3$ (mol %) in terms of $B_2O_3$, the Zn component in an amount of NZnO (mol %) in terms of ZnOC the Ba component in an amount of NBaO (mol %) in terms of BaO, and the Sr component in an amount of NSrO (mol %) in terms of SrO, NB203/(NZnO+NBaO+NSrO) is 0.5 to 2.0.

6. The spark plug as set forth in claim 1, wherein the glaze layer further contains 0.5 to 5 mol % in total of at least one of Ti, Zr and Hf in terms of $TiO_2$, $ZrO_2$ and $HfO_2$, respectively.

7. The spark plug as set forth in claim 1, wherein the glaze layer further contains 0.5 to 5 mol % in total of at least one of No, Fe, W, Ni, Co, and Mn in terms of $MoO_3$, $Fe_2O_3$, $WO_3$, $Ni_3O_4$, $Co_3O_4$, and $MnO_2$, respectively.

8. The spark plug as set forth in claim 1, wherein the glaze layer further contains 0.5 to 12 mol % in total of 0.5 to 10 mol % of a Ca component in terms of CaO, and 0.5 to 10 mol % of a Mg component in terms of MgO.

9. The spark plug as set forth in claim 1, wherein the glaze layer further contains 5 mol % or less in total of at least one of Ba, Sn, Sb, P, Cu, Ce and Cr in terms of $Bi_2O_3$, $SnO_2$, $Sb_2O_5$, $P_2O_3$, Cuo, $CeO_2$ and $Cr_2O_3$, respectively.

10. The spark plug as set forth in claim 1, wherein the insulator is formed with a projection part in an outer circumferential direction at an axially central position thereof, taking, as a front side, a side directing toward the front end of the center electrode in the axial direction, a cylindrical face is shaped in the outer circumferential face at the base portion of the insulator main body in the neighborhood of a rear side opposite the projection part, and the outer circumferential face at the base portion is covered with the glaze layer formed with the film thickness ranging 7 to 50 $\mu$m.

11. The spark plug as set forth in claim 1, wherein, taking, as a backward direction, a side remote from spark discharge gap in an axial direction of the insulator, the metal shell is fixed such that the backward part of the insulator projecting from the metal shell is perpendicular with respect to a test article securing bed, while an arm of 330 mm length furnished at the front end with a steel made hammer of 1.13 kg is turnably attached to an axial fulcrum located on a center axial line of the insulator at a more upper part of the backward part of the insulator, and a location of the axial fulcrum is determined such that a position of the hammer when it is brought down onto the backward part of the insulator is 1 mm as a distance in the vertical direction from the backward face of the insulator, the hammer is brought up such that a turning angle of the arm is as predetermined angle from the center axial line, and when operation of bringing down the hammer owing to free dropping toward the backward part of the insulator is repeated as stepwise making larger at distance of 2 degree, impact endurance angle demanded as a limit angle when cracks appear in the insulator is 35 degree or more.

12. The spark plug as set forth in claim 1, wherein the spark plug is furnished, in a crazing hole of the insulator, with a metal fixture as one body with the center electrode or holding a conductive binding layer in relation therewith, said metal fixture being separate from the center electrode, and an insulation resistant value is 200 MΩ or more, which is measured by keeping the whole of the spark plug at about 500° C. and passing current between the terminal metal fixture and the metal shell.

13. The spark plug as set forth in claim 1, wherein the insulator comprises an alumina insulating material containing 85 to 98 mol % of an Al component in terms of $Al_2O_3$, and the glaze layer has an average thermal expansion coefficient at the temperature ranging 20 to 350° C. is $50\times10^{-7}$/° C. to $85\times10^{-7}$/° C.

14. The spark plug as set forth in claim 1, wherein the glaze layer has a softening point of 600 to 700° C.

* * * * *